US010886708B2

(12) United States Patent
Itoh et al.

(10) Patent No.: US 10,886,708 B2
(45) Date of Patent: Jan. 5, 2021

(54) SPARK PLUG FOR INTERNAL COMBUSTION ENGINE

(71) Applicant: DENSO CORPORATION, Kariya (JP)

(72) Inventors: Shintaro Itoh, Nisshin (JP); Daisuke Tanaka, Nisshin (JP); Akimitsu Sugiura, Kariya (JP); Ryota Wakasugi, Nisshin (JP); Kaori Doi, Kariya (JP); Kanechiyo Terada, Kariya (JP); Tetsuya Miwa, Kariya (JP); Fumiaki Aoki, Nisshin (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/584,998

(22) Filed: Sep. 27, 2019

(65) Prior Publication Data

US 2020/0028333 A1 Jan. 23, 2020

Related U.S. Application Data

(63) Continuation of application No. PCT/JP2018/013102, filed on Mar. 29, 2018.

(30) Foreign Application Priority Data

Mar. 31, 2017 (JP) ..... 2017-069872
Mar. 20, 2018 (JP) ..... 2018-052539

(51) Int. Cl.
*H01T 13/32* (2006.01)
*H01T 13/52* (2006.01)

(52) U.S. Cl.
CPC ..... *H01T 13/32* (2013.01); *H01T 13/52* (2013.01)

(58) Field of Classification Search
CPC ..... H01T 13/32; H01T 13/52; H01T 13/20
See application file for complete search history.

(56) References Cited

U.S. PATENT DOCUMENTS

| | | | |
|---|---|---|---|
| 4,695,758 | A | 9/1987 | Nishida et al. |
| 4,798,991 | A | 1/1989 | Benedikt et al. |
| 4,939,409 | A | 7/1990 | Friese et al. |
| 2012/0181916 | A1 | 7/2012 | Burrows et al. |
| 2012/0312268 | A1 | 12/2012 | Shionoya et al. |
| 2015/0188292 | A1 | 7/2015 | Strong et al. |

(Continued)

FOREIGN PATENT DOCUMENTS

| | | |
|---|---|---|
| GB | 2 149 852 | 6/1985 |
| JP | S61-022589 | 1/1986 |
| JP | S61-032979 | 2/1986 |

(Continued)

*Primary Examiner* — Joseph L Williams
(74) *Attorney, Agent, or Firm* — Nixon & Vanderhye PC

(57) ABSTRACT

A spark plug has a tubular ground electrode, an insulator, and a center electrode. The insulator has an insulator protruding portion protruding to a tip end side in a plug axial direction with respect to the ground electrode. The center electrode 4 has an exposed portion exposed through a tip end of the insulator protruding portion. The exposed portion of the center electrode has a first part covering the insulator protruding portion from the tip end side in the plug axial direction, and a second part extending from the first part to a base end side in the plug axial direction and covering the entire circumference of an outer peripheral surface of the insulator protruding portion from an outer peripheral side in a plug radial direction.

13 Claims, 24 Drawing Sheets

(56) References Cited

U.S. PATENT DOCUMENTS

2016/0072259 A1 3/2016 Kinoshita et al.

FOREIGN PATENT DOCUMENTS

| | | |
|---|---|---|
| JP | S61-292875 | 12/1986 |
| JP | S63-167077 | 7/1988 |
| JP | H01-265476 | 10/1989 |
| JP | H07-073956 | 3/1995 |
| JP | 2015-181088 | 10/2015 |
| JP | 2016-062769 | 4/2016 |
| WO | 2013/099672 | 5/2015 |

SPARK PLUG FOR INTERNAL COMBUSTION ENGINE

CROSS-REFERENCE TO RELATED APPLICATION

The present application is a continuation application of International Application No. PCT/JP2018/013102, filed Mar. 29, 2018, which claims the benefit of priority from earlier Japanese Patent Applications No. 2017-69872, filed Mar. 31, 2017, and No. 2018-52539, filed Mar. 20, 2018, the descriptions of which are incorporated herein by reference.

TECHNICAL FIELD

The present disclosure relates to a spark plug for an internal combustion engine.

BACKGROUND

As disclosed in JP S61-292875 A, for example, there is known a spark plug for an internal combustion engine that is configured to apply high-frequency voltage to a center electrode to generate discharge between a ground electrode and the center electrode. Such a spark plug generates creeping spark discharge along a surface of an insulator between the center electrode and the ground electrode.

SUMMARY

A first aspect of the present disclosure is an internal combustion engine spark plug including a tubular ground electrode, a tubular insulator arranged inside the ground electrode and having an insulator protruding portion protruding to a tip end side in a plug axial direction with respect to a tip end of the ground electrode, and a center electrode held inside the insulator and having an exposed portion exposed through a tip end of the insulator protruding portion. The exposed portion of the center electrode has a first part covering the insulator protruding portion from the tip end side in the plug axial direction, and a second part extending from the first part to a base end side in the plug axial direction and covering the entire circumference of an outer peripheral surface of the insulator protruding portion from an outer peripheral side in a plug radial direction. An axial gap is formed between the first part and the insulator protruding portion in the plug axial direction.

DETAILED DESCRIPTION OF THE PREFERRED EMBODIMENTS

Figure 1:
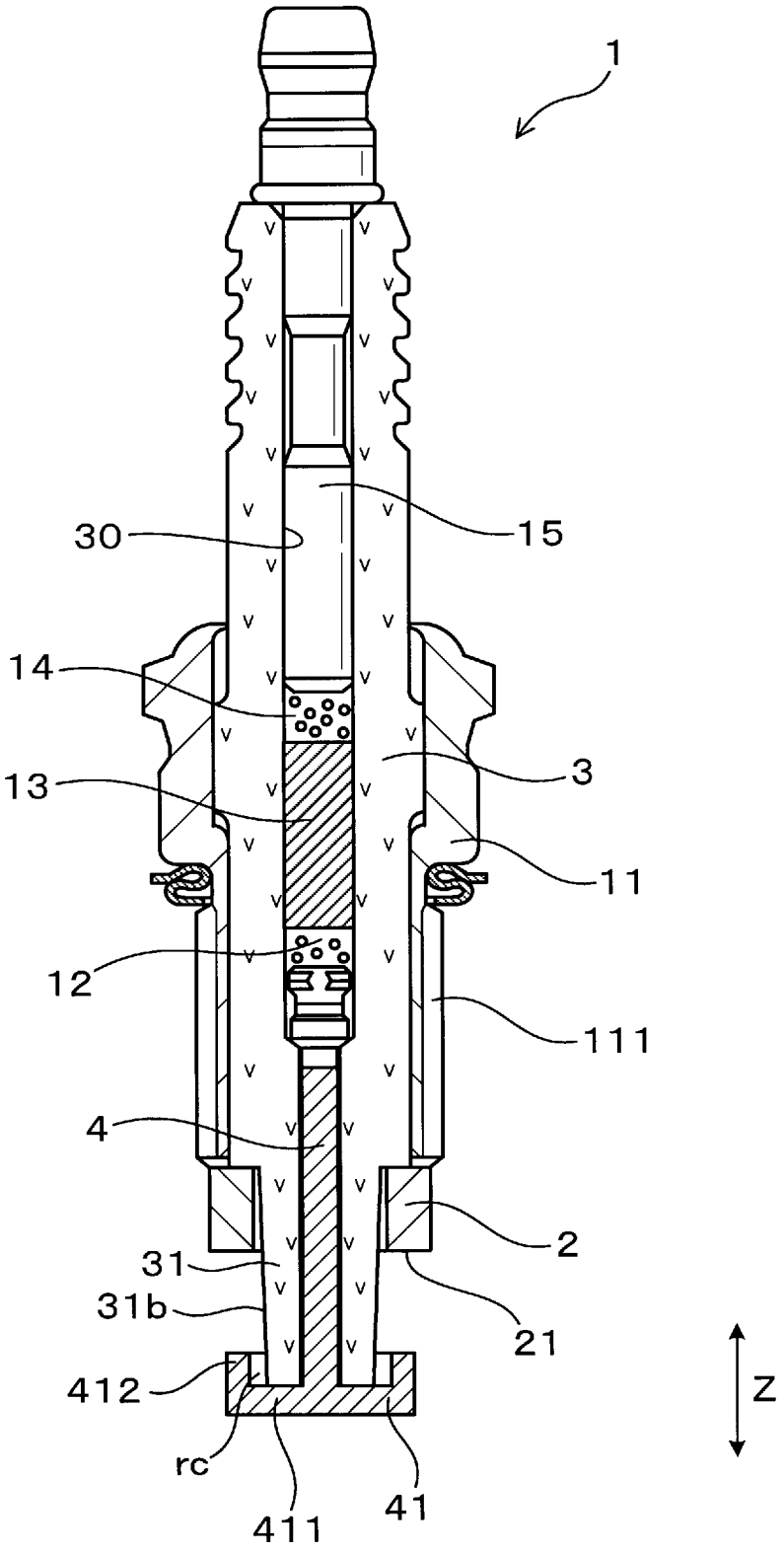
FIG. 1 is a sectional view of an internal combustion engine spark plug of a first embodiment.

In the spark plug disclosed in JP S61-292875 A, the insulator is arranged inside the tubular ground electrode, and the center electrode is arranged further inside the insulator. The insulator is arranged such that a tip end thereof protrudes to a tip end side of the ground electrode. Moreover, the center electrode is arranged such that a tip end thereof protrudes to a tip end side of the insulator.

However, in the spark plug described in JP S61-292875 A, a corner portion (i.e., a corner between a tip end surface and an outer peripheral surface of the insulator) of a tip end portion of the insulator is exposed. Thus, creeping spark discharge along a surface of the corner portion of the insulator is formed between the center electrode and the ground electrode. Thus, the discharge generated between the center electrode and the ground electrode is less detached from a surface of the insulator, specifically the surface of the corner portion. Thus, in the spark plug, the discharge generated between the center electrode and the ground electrode is less greatly extended by an air flow in a combustion chamber, and performance of ignition of an air-fuel mixture is less ensured.

The present disclosure has been made in view of such problems, and is intended to provide an internal combustion engine spark plug configured so that performance of ignition of an air-fuel mixture can be improved.

A first aspect of the present disclosure is an internal combustion engine spark plug including a tubular ground electrode, a tubular insulator arranged inside the ground electrode and having an insulator protruding portion protruding to a tip end side in a plug axial direction with respect to a tip end of the ground electrode, and a center electrode held inside the insulator and having an exposed portion exposed through a tip end of the insulator protruding portion. The exposed portion of the center electrode has a first part covering the insulator protruding portion from the tip end side in the plug axial direction, and a second part extending from the first part to a base end side in the plug axial direction and covering the entire circumference of an outer peripheral surface of the insulator protruding portion from an outer peripheral side in a plug radial direction. An axial gap is formed between the first part and the insulator protruding portion in the plug axial direction.

Moreover, a second aspect of the present disclosure is an internal combustion engine spark plug including a tubular ground electrode, a tubular insulator arranged inside the ground electrode and having an insulator protruding portion protruding to a tip end side in a plug axial direction with respect to a tip end of the ground electrode, and a center electrode held inside the insulator and having an exposed portion exposed through a tip end of the insulator protruding portion. The exposed portion of the center electrode has a first part covering the insulator protruding portion from the tip end side in the plug axial direction, and a second part extending from the first part to a base end side in the plug axial direction and covering an entire circumference of an outer peripheral surface of the insulator protruding portion from an outer peripheral side in a plug radial direction. The exposed portion of the center electrode is formed within the ground electrode as viewed in the plug axial direction.

Moreover, a third aspect of the present disclosure is an internal combustion engine spark plug including a tubular ground electrode, a tubular insulator arranged inside the ground electrode and having an insulator protruding portion protruding to a tip end side in a plug axial direction with respect to a tip end of the ground electrode, and a center electrode held inside the insulator and having an exposed portion exposed through a tip end of the insulator protruding portion. The exposed portion of the center electrode has a first part covering the insulator protruding portion from the tip end side in the plug axial direction, and a second part extending from the first part to a base end side in the plug axial direction and covering a part of an outer peripheral surface of the insulator protruding portion in a plug circumferential direction from an outer peripheral side in a plug radial direction. At least a region, in which the second part is formed, of the insulator protruding portion in the plug circumferential direction has a step shape having an outer diameter that decreases in a stepwise manner toward the tip end side in the plug axial direction. As viewed in the plug axial direction, the exposed portion of the center electrode is formed within the ground electrode.

In the internal combustion engine of the first aspect, the exposed portion of the center electrode has the first part and the second part. That is, a corner portion of a tip end portion of the insulator protruding portion is covered with the first part and the second part of the center electrode. Thus, discharge is formed between the second part of the center electrode and the ground electrode without generation of discharge on the corner portion of the tip end portion of the insulator protruding portion. Thus, due to an air flow of an air-fuel mixture in a combustion chamber or electrical repulsion, the discharge is easily detached from a surface of the insulator protruding portion, and is easily extended to a downstream side. Accordingly, performance of ignition of the air-fuel mixture can be improved. Moreover, an entirety between the exposed portion of the center electrode covering the entire circumference of the tip end portion of the insulator protruding portion and the ground electrode covering the entire circumference of the insulator protruding portion serves as a discharge formable region. Thus, creeping discharge is repeatedly formed in a particular path of the surface of the insulator protruding portion, and therefore, concentration of so-called channeling, which is erosion of an insulator surface in a groove shape, on the particular path can be prevented from occurring.

In the internal combustion engine spark plug of the third aspect, a part of the corner portion of the tip end portion of the insulator protruding portion is covered with the first part and the second part of the center electrode. Thus, in the present aspect, discharge is also formed between the second part of the center electrode and the ground electrode without generation of discharge on the corner portion of the tip end portion of the insulator protruding portion. Thus, due to the air flow of the air-fuel mixture in the combustion chamber or electrical repulsion, the discharge is easily detached from the surface of the insulator protruding portion, and is easily extended to the downstream side. Accordingly, the performance of ignition of the air-fuel mixture can be improved.

Further, in the internal combustion engine spark plug of the third aspect, at least the region, in which the second part is formed, of the insulator protruding portion in the plug circumferential direction has, along the entirety in the plug axial direction, such a step shape that the outer diameter decreases in the stepwise manner toward the tip end side in the plug axial direction. Thus, a path from the second part to the ground electrode along the surface of the insulator protruding portion can be extended. Accordingly, a distance for creeping discharge can be ensured without extension of the insulator protruding portion in the plug axial direction, and the ignition performance can be enhanced. Further, an area of the section of the tip end portion of the insulator protruding portion perpendicular to the plug axial direction is decreased, and therefore, thermal losses due to loss of heat from the flame generated by the discharge of the spark plug by the insulator protruding portion can be reduced. This also can improve the performance of ignition of the air-fuel mixture.

As described above, according to each of the above-described aspects, the internal combustion engine spark plug being configured so that the performance of ignition of the air-fuel mixture can be improved can be provided.

First Embodiment

An embodiment of a spark plug for an internal combustion engine will be described with reference to FIGS. 1 to 8.

As illustrated in FIG. 1, a spark plug 1 for an internal combustion engine in the present embodiment has a tubular ground electrode 2, a tubular insulator 3 arranged inside the ground electrode 2, and a center electrode 4 held inside the insulator 3. The insulator 3 has an insulator protruding portion 31 protruding to a tip end side in a plug axial direction Z with respect to the ground electrode 2. The center electrode 4 has an exposed portion 41 exposed through a tip end of the insulator protruding portion 31. Note that the plug axial direction Z means a direction in which the center axis of the spark plug 1 extends. Moreover, in FIG. 1, some parts of the center electrode 4 is illustrated in a sectional view, and the remaining parts of the center electrode 4 is illustrated in a front view.

Figure 2:
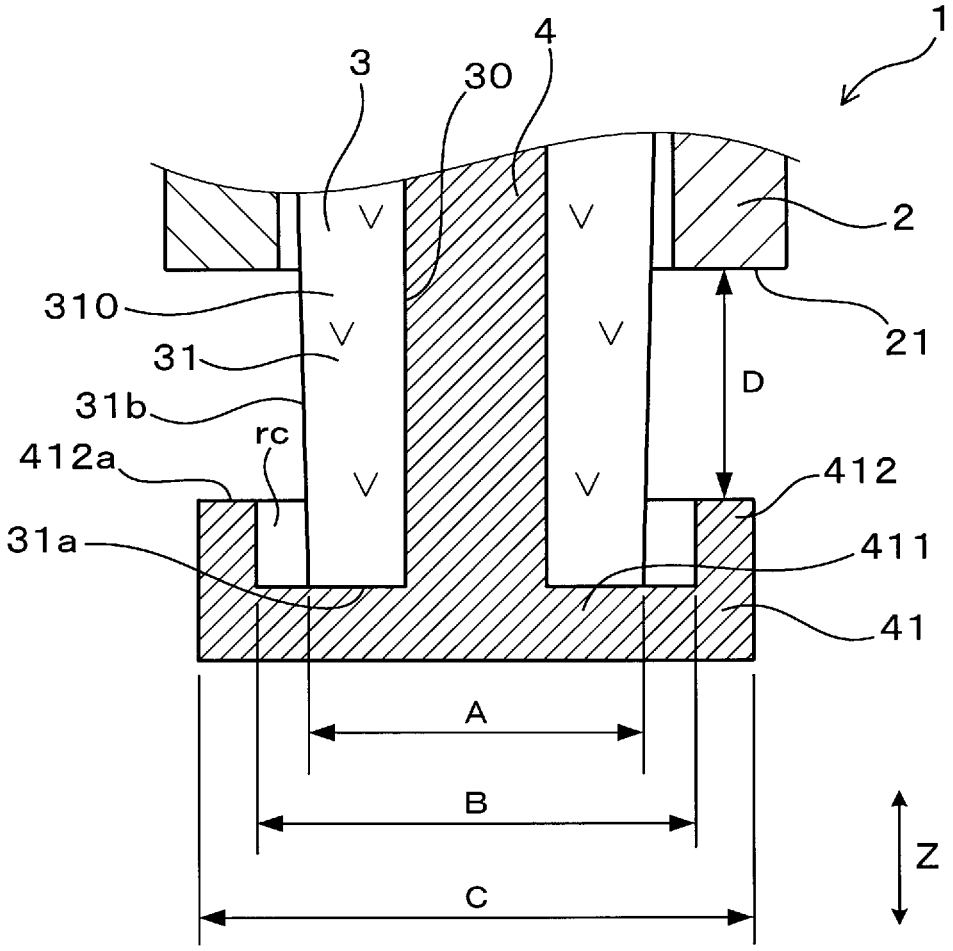
FIG. 2 is an enlarged sectional view of a periphery of a tip end portion of the spark plug in the first embodiment.

As illustrated in FIGS. 1 and 2, the exposed portion 41 of the center electrode 4 has a first part 411 and a second part 412. The first part 411 covers the insulator protruding portion 31 from the tip end side in the plug axial direction Z. The second part 412 extends from the first part 411 to a base end side in the plug axial direction Z, and covers the entire circumference of an outer peripheral surface 31*b* of the insulator protruding portion 31 from an outer peripheral side in a plug radial direction. Note that the plug radial direction means a radial direction of the spark plug 1. Moreover, when a plug circumferential direction is indicated, such a direction means a circumferential direction of the spark plug 1. When a plug center axis is indicated, such an axis means the center axis of the spark plug 1.

The spark plug 1 of the present embodiment can be, for example, used as an ignition means in the internal combustion engine for a vehicle such as an automobile. The spark plug 1 for the internal combustion engine is configured to apply high voltage to the center electrode 4 to generate discharge between the ground electrode 2 and the center electrode 4. The spark plug 1 is connected to a not-shown high-voltage power source unit on one end side in the plug axial direction Z, and is arranged in a combustion chamber of the internal combustion engine on the other end side. The high-voltage power source unit includes, for example, a general ignition coil, a power source of an ignition device capable of continuously controlling discharge, and a high-frequency power source capable of applying a high-frequency voltage of 200 kHz to 5 MHz to the center electrode 4.

In the present specification, in the plug axial direction Z, a side on which the spark plug 1 is inserted into the combustion chamber will be referred to as a tip end side, and the opposite side will be referred to as a base end side.

Figure 4:
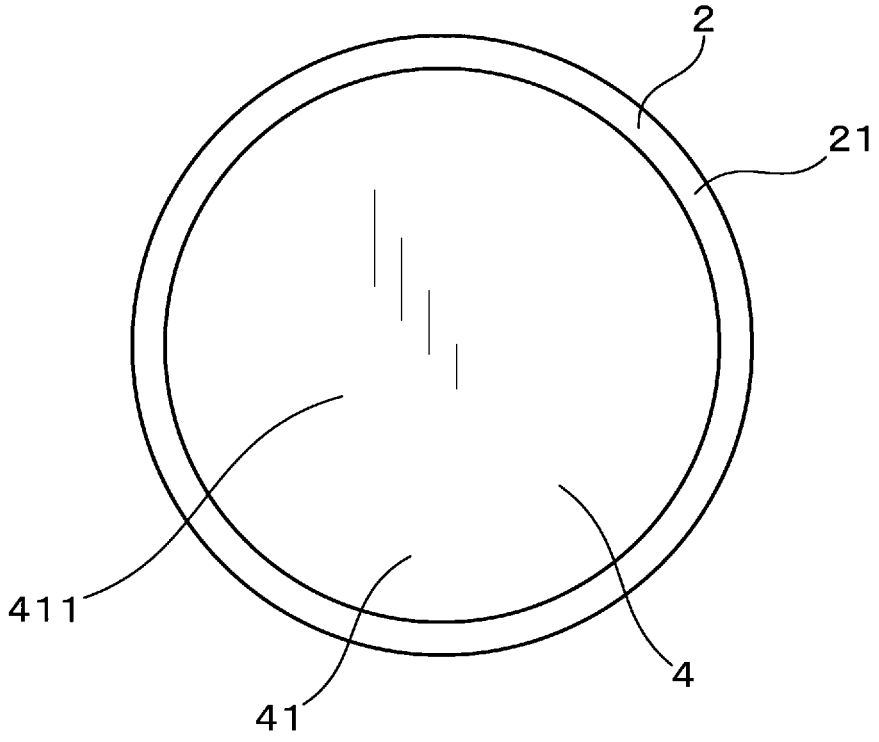
FIG. 4 is a view of a center electrode and a ground electrode viewed from a tip end side in a plug axial direction in the first embodiment.

The ground electrode 2 is in a tubular shape. The ground electrode 2 is formed to surround the insulator 3 along the entire circumference thereof. As illustrated in FIG. 4, a tip end surface 21 of the ground electrode 2 is in a circular ring shape. The tip end surface 21 is perpendicular to the plug axial direction Z. The tip end surface 21 of the ground electrode 2 is, along the entirety thereof, formed flush with a plane perpendicular to the plug axial direction Z. As illustrated in FIG. 2, an angle between the tip end surface 21 and an inner peripheral surface of the ground electrode 2 is a right angle.

As illustrated in FIGS. 1 and 2, the insulator 3 has a through-hole 30 penetrating the insulator 3 in the plug axial direction Z. The sectional shape of the insulator 3 perpendicular to the plug axial direction Z is in a circular ring shape. A part of the insulator 3 is arranged inside the ground electrode 2 while the insulator protruding portion 31 protrudes to the tip end side with respect to the tip end surface 21 of the ground electrode 2. An outer peripheral surface of the insulator 3 faces the inner peripheral surface of the ground electrode 2 in the plug radial direction through a minute clearance. Note that the minute clearance is not necessarily formed. That is, the outer peripheral surface of the insulator 3 and the inner peripheral surface of the ground electrode 2 may contact each other.

Figure 3:
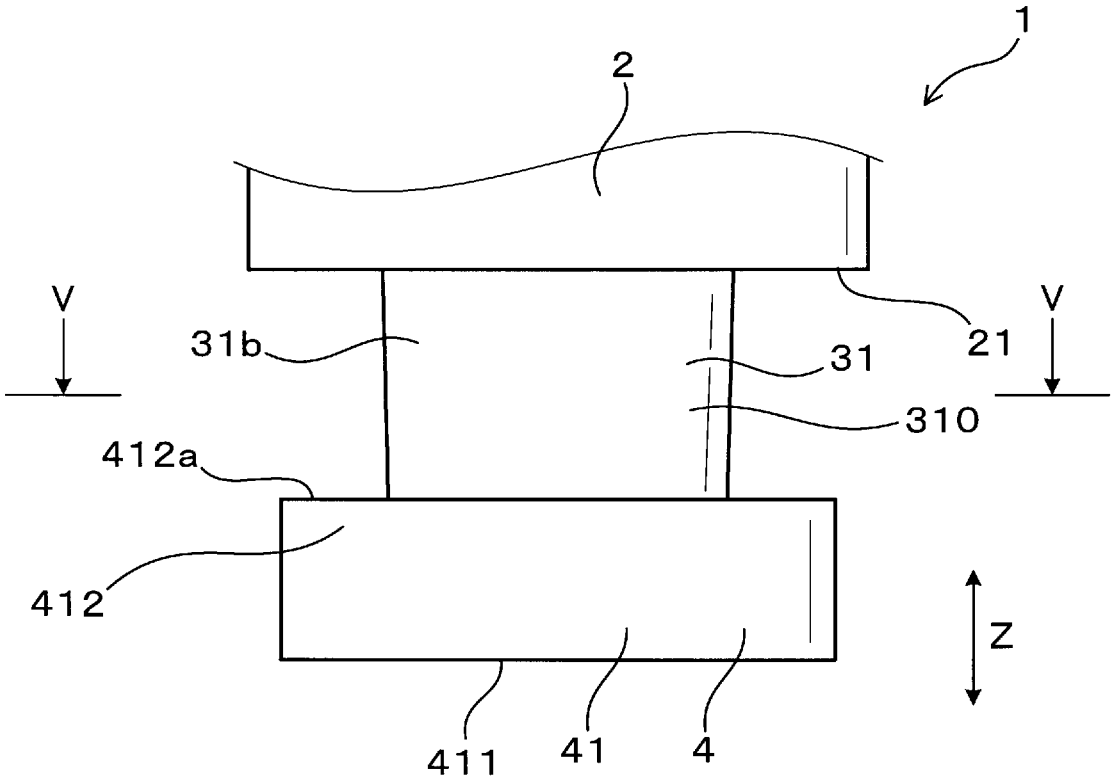
FIG. 3 is an enlarged side view of the periphery of the tip end portion of the spark plug in the first embodiment.

As illustrated in FIGS. 2 and 3, the outer peripheral surface 31*b* of the insulator protruding portion 31 is inclined toward an inner peripheral side in the plug radial direction as extending toward the tip end side in the plug axial direction Z. As illustrated in FIG. 2, the outer peripheral surface 31*b* of the insulator protruding portion 31 has such a linear shape that a sectional shape parallel to the plug axial direction Z is inclined toward the inner peripheral side in the plug radial direction as extending toward the tip end side. Accordingly, an outer peripheral surface of an insulator exposed portion 310 of the insulator protruding portion 31 exposed through both of the center electrode 4 and the ground electrode 2 is also inclined toward the inner peripheral side in the plug radial direction as extending toward the tip end side in the plug axial direction Z. Moreover, the outer peripheral surface of the insulator exposed portion 310 also has such a linear shape that a sectional shape parallel to the plug axial direction Z is inclined toward the inner peripheral side in the plug radial direction as extending toward the tip end side. In the present embodiment, the insulator exposed portion 310 is, in the plug axial direction Z, a part of the insulator protruding portion 31 between the tip end surface 21 of the ground electrode 2 and an end surface 412*a* of the second part 412 of the center electrode 4 on the base end side in the plug axial direction Z.

As illustrated in FIG. 2, a tip end surface 31*a* of the insulator protruding portion 31 is formed perpendicularly to the plug axial direction Z. The angle of a corner portion between the tip end surface 31*a* and the outer peripheral surface 31*b* of the insulator protruding portion 31 is formed as an obtuse angle. The corner portion between the tip end surface 31*a* and the outer peripheral surface 31*b* of the insulator protruding portion 31 is positioned on the tip end side in the plug axial direction Z with respect to the end surface 412*a* of the second part 412. The corner portion between the tip end surface 31*a* and the outer peripheral surface 31*b* of the insulator protruding portion 31 is not a part of the insulator exposed portion 310. That is, the corner portion between the tip end surface 31*a* and the outer peripheral surface 31*b* of the insulator protruding portion 31 is covered with the first part 411 and the second part 412 of the center electrode 4, and is not exposed through the center electrode 4.

The center electrode 4 is inserted into and held at a tip end portion of the through-hole 30 of the insulator 3. The center electrode 4 is, as a whole, in a substantially circular columnar shape.

The exposed portion 41 of the center electrode 4 is, as a whole, in a cup shape opening toward the base end side in the plug axial direction Z. The exposed portion 41 has the first part 411 formed in a discoid shape as illustrated in FIG. 4, and the second part 412 extending from an outer edge portion of the first part 411 to the base end side and entirely formed in a cylindrical shape as illustrated in FIG. 2. As illustrated in FIG. 2, the first part 411 faces, in the plug axial direction Z, the entirety of the tip end surface 31*a* of the insulator protruding portion 31. The second part 412 covers the entire circumference of the outer peripheral surface 31*b* of the insulator protruding portion 31 from the outer peripheral side of the insulator protruding portion 31. Thus, the exposed portion 41 covers the entirety of a corner portion of a tip end portion of the insulator protruding portion 31. Note that in the plug radial direction, a radial gap rc is formed between the outer peripheral surface 31*b* of the insulator protruding portion 31 and an inner peripheral surface 412*b* of the second part 412. That is, the inner peripheral surface 412*b* of the second part 412 is formed at a position apart from the outer peripheral surface 31*b* of the insulator protruding portion 31 to the outer peripheral side in the plug radial direction. The radial gap rc opens toward the base end side in the plug axial direction Z. Note that the radial gap rc is not necessarily formed. That is, the inner peripheral surface 412*b* of the second part 412 may contact the outer peripheral surface 31*b* of the insulator protruding portion 31.

Figure 5:
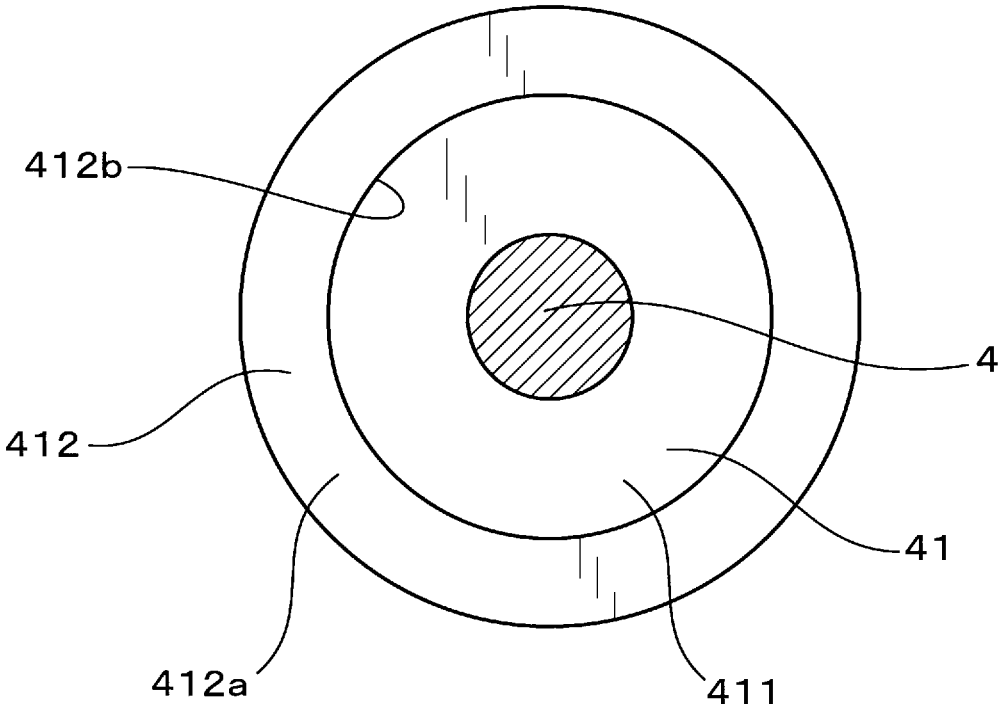
FIG. 5 is a view of only the center electrode in a section along a line V-V of FIG. 3.

As illustrated in FIG. 5, the end surface 412*a* of the second part 412 on the base end side in the plug axial direction Z is in a circular ring shape. Moreover, the end surface 412*a* of the second part 412 on the base end side in the plug axial direction Z is perpendicular to the plug axial direction Z. As illustrated in FIG. 2, a spatial distance between the second part 412 of the center electrode 4 and the ground electrode 2 is constant along the entire circumference. That is, in any section passing through both of the center electrode 4 and the ground electrode 2 and being parallel to the plug axial direction Z, the spatial distance between the center electrode 4 and the ground electrode 2 is substantially constant. Moreover, the end surface 412*a* of the second part 412 and the tip end surface 21 of the ground electrode 2 directly face each other, and the insulator 3 is not interposed therebetween.

As illustrated in FIG. 2, the diameter of the tip end surface 31*a* of the insulator protruding portion 31 is defined as a diameter A [mm], the inner diameter of the base-end-side end surface 412*a* of the second part 412 is defined as an inner diameter B [mm], the outer diameter of the end surface 412*a* is defined as an outer diameter C [mm], and the shortest spatial distance between the ground electrode 2 and the center electrode 4 is defined as a spatial distance D [mm]. In this state, the diameter A, the inner diameter B, and the outer diameter C satisfy a relation of $A<B<C$. Moreover, the diameter A and the inner diameter B preferably satisfy A+0.25 mm B. Moreover, the inner diameter B and the outer diameter C preferably satisfy B+1.0 mm C. Moreover, the spatial distance D preferably satisfies $3.0\ \text{mm} \leq D \leq 5.0\ \text{mm}$. In the present embodiment, the diameter A is 4.55 mm, the inner diameter B is 5.55 mm, the outer diameter C is 6.5 mm, and the spatial distance D is 5.0 mm. Moreover, in the present embodiment, the length of the second part 412 in the plug axial direction Z is 1.0 mm.

The exposed portion 41 may be formed separately from a part of the center electrode 4 within the insulator protruding portion 31, or may be formed integrally with such a part.

As illustrated in FIG. 1, the ground electrode 2 extends from a tip end of a housing 11 to the tip end side. The housing 11 is in a tubular shape, and holds the insulator 3 inside. An attachment screw portion 111 to be screwed into the internal combustion engine is formed at an outer peripheral surface of the housing 11. The ground electrode 2 is joined to a tip end portion of a part of the housing 11 provided with the attachment screw portion 111.

A resistor 13 is arranged on the base end side of the center electrode 4 in the through-hole 30 of the insulator 3 through a glass seal 12 having conductivity. The resistor 13 can be formed in such a manner that a resistor composition containing a resistive material such as carbon or ceramic powder and glass powder is heated and sealed, or can be configured in such a manner that a cartridge resistor is inserted. The glass seal 12 is made of copper glass formed by mixing of glass with copper powder. Moreover, on the base end side of the resistor 13, a stem 15 is arranged through a glass seal 14 made of copper glass. The stem 15 is, for example, made of iron alloy. A base end portion of the stem 15 protrudes from the insulator 3. Moreover, the spark plug 1 is connected to the high-voltage power source unit at a protruding portion of the stem 15.

Next, features and advantageous effects of the present embodiment will be described.

In the spark plug 1 for the internal combustion engine in the present embodiment, the exposed portion 41 of the center electrode 4 has the first part 411 and the second part 412. That is, the corner portion of the tip end portion of the insulator protruding portion 31 is covered with the first part 411 and the second part 412 of the center electrode 4. This can prevent generation, sustention, and fixing of discharge on the corner portion of the tip end portion of the insulator protruding portion 31. Thus, due to an air flow of an air-fuel mixture in the combustion chamber or electrical repulsion, discharge is easily detached from a surface of the insulator protruding portion, and is easily extended to a downstream side. Accordingly, performance of ignition of the air-fuel mixture can be improved. Further, occurrence of channeling at the corner portion of the tip end portion of the insulator protruding portion 31 can be prevented. Moreover, the entirety between the exposed portion of the center electrode covering the entire circumference of the tip end portion of the insulator protruding portion and the ground electrode covering the entire circumference of the insulator protruding portion serves as a discharge formable region. Thus, creeping discharge is repeatedly formed in a particular path of the surface of the insulator protruding portion, and therefore, concentration of so-called channeling, which is erosion of an insulator surface in a groove shape, on the particular path can be prevented from occurring.

Moreover, the end surface 412*a* of the second part 412 on the base end side in the plug axial direction Z is perpendicular to the plug axial direction Z. Further, the tip end surface 21 of the ground electrode 2 is also perpendicular to the plug axial direction Z. Thus, discharge generated between the center electrode 4 and the ground electrode 2 is easily detached from a surface of the insulator exposed portion 310, and is easily greatly extended to the downstream side of the air flow by the air flow in the combustion chamber of the internal combustion engine attached to the spark plug 1. This will be described later.

Figure 6:
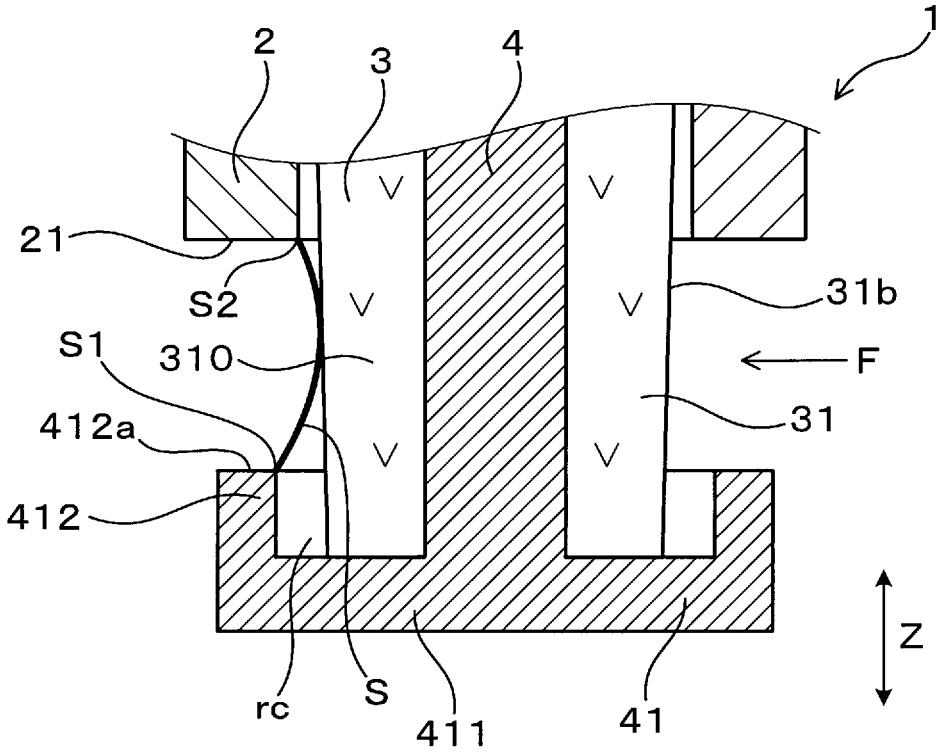
FIG. 6 is the enlarged sectional view of the periphery of the tip end portion of the spark plug in the first embodiment for describing initial discharge spark.

As illustrated in FIG. 6, in the present embodiment, discharge is generated starting, as the points of origin, from an inner peripheral end of the end surface 412*a* of the second part 412 on the base end side in the plug axial direction Z and an inner peripheral end of the tip end surface 21 of the ground electrode 2. Moreover, a part between both points of origin of the discharge spark S generated by such discharge is formed along the outer peripheral surface of the insulator exposed portion 310 of the insulator protruding portion 31.

Figure 7:
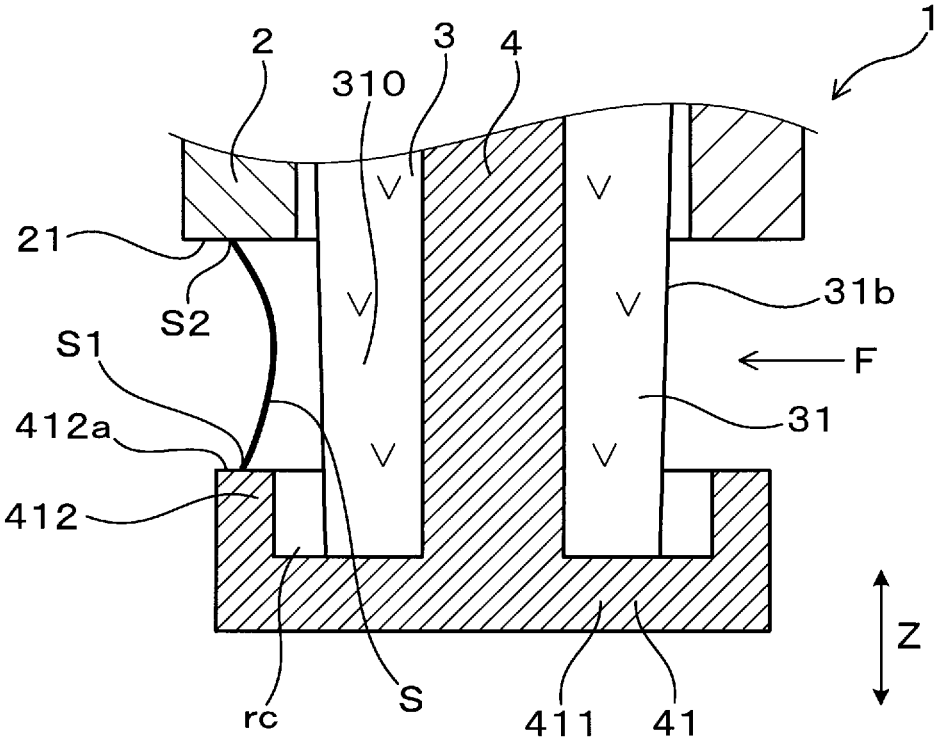
FIG. 7 is the enlarged sectional view of the periphery of the tip end portion of the spark plug in the first embodiment for describing a state in which the discharge spark is extended by an air flow and moves apart from a surface of an insulator protruding portion.
Figure 8:
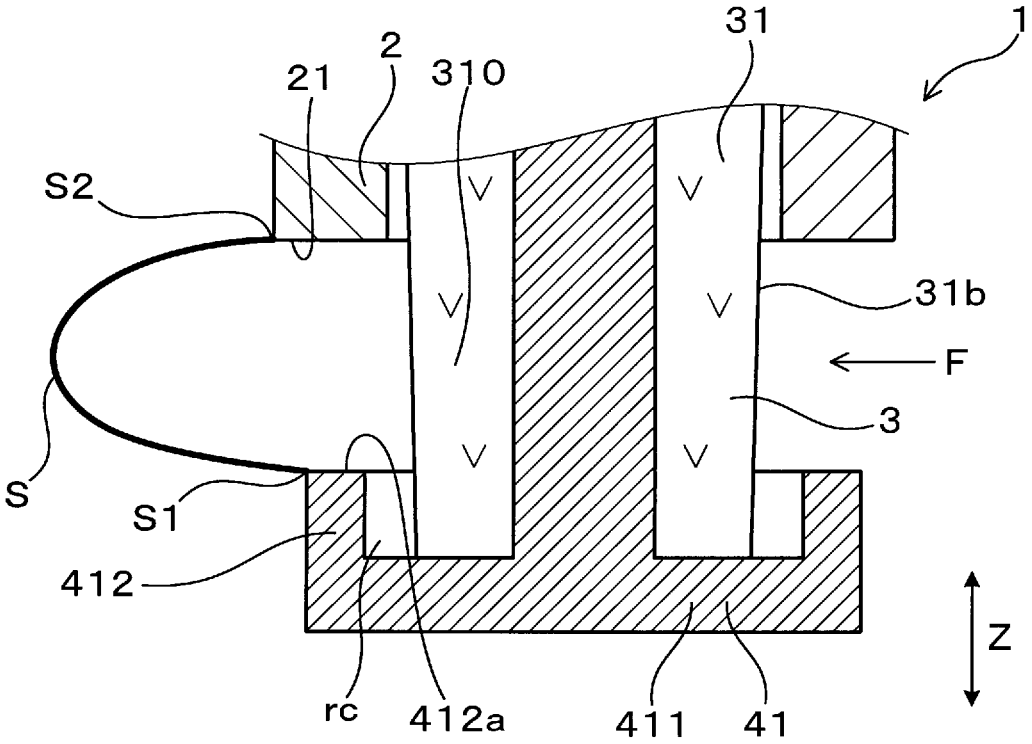
FIG. 8 is the enlarged sectional view of the periphery of the tip end portion of the spark plug in the first embodiment for describing a state in which the discharge spark is extended by the air flow and is greatly extended.

Then, as illustrated in FIGS. 6 to 8, both points of origin of the discharge spark S are, in the combustion chamber of the internal combustion engine attached to the spark plug 1, extended by an air flow F flowing in a direction perpendicular to the plug axial direction Z, and moves toward the outer peripheral side in the plug radial direction on the end surface 412*a* of the second part 412 and the tip end surface 21 of the ground electrode 2. That is, the point S1 of origin of the discharge spark S on a center electrode 4 side moves from an inner peripheral end portion to an outer peripheral end portion of the end surface 412*a* of the second part 412, and the point S2 of origin of the discharge spark S on a ground electrode 2 side moves from an inner peripheral end portion to an outer peripheral end portion of the tip end surface 21 of the ground electrode 2. Thus, both points of origin of the discharge spark S move in a direction apart from the insulator exposed portion 310 in the plug radial direction.

In association with movement of both points of origin of the discharge spark S in the direction apart from the insulator exposed portion 310 in the plug radial direction, the part between both points of origin of the discharge spark S also moves, as illustrated in FIGS. 6 to 8, apart from the outer peripheral surface of the insulator exposed portion 310 to the outer peripheral side. Then, as illustrated in FIG. 8, the part between both points of origin of the discharge spark S having moved apart from the outer peripheral surface of the insulator exposed portion 310 toward the outer peripheral side is, by the air flow F in the combustion chamber, greatly extended toward the downstream side of the air flow F. Accordingly, in the present embodiment, the area of contact between the discharge spark S and the air-fuel mixture is earned, and the performance of ignition of the air-fuel mixture is easily ensured. Moreover, an air-fuel mixture ignition point is separated from the spark plug 1, and therefore, thermal losses due to drawing of heat of initially-formed fire, i.e., heat of initial fire, by the spark plug 1 can be reduced.

Figure 9:
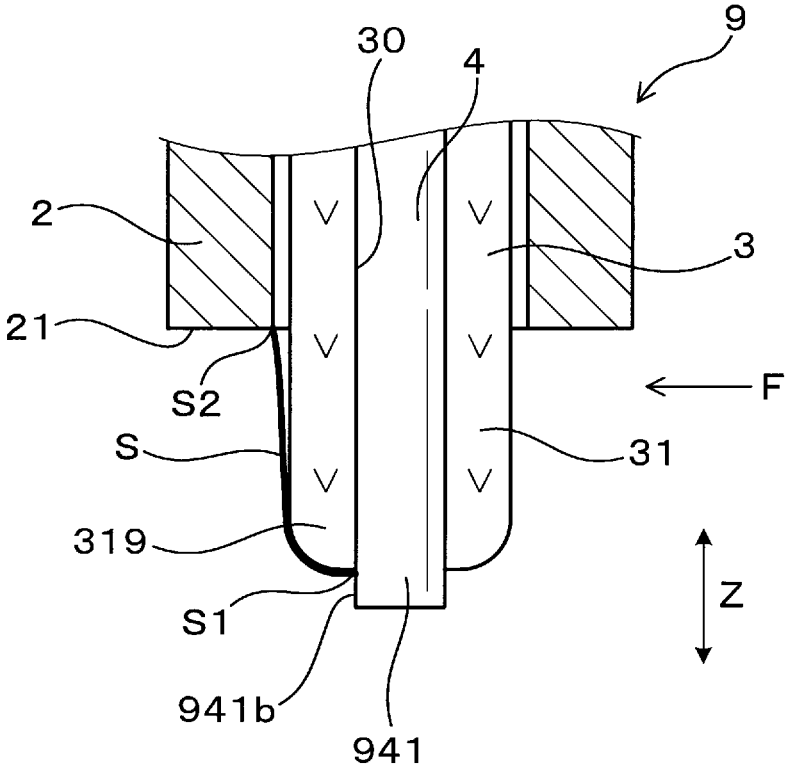
FIG. 9 is an enlarged sectional view of a periphery of a tip end portion of a spark plug in a comparative form for describing initial discharge spark.
Figure 10:
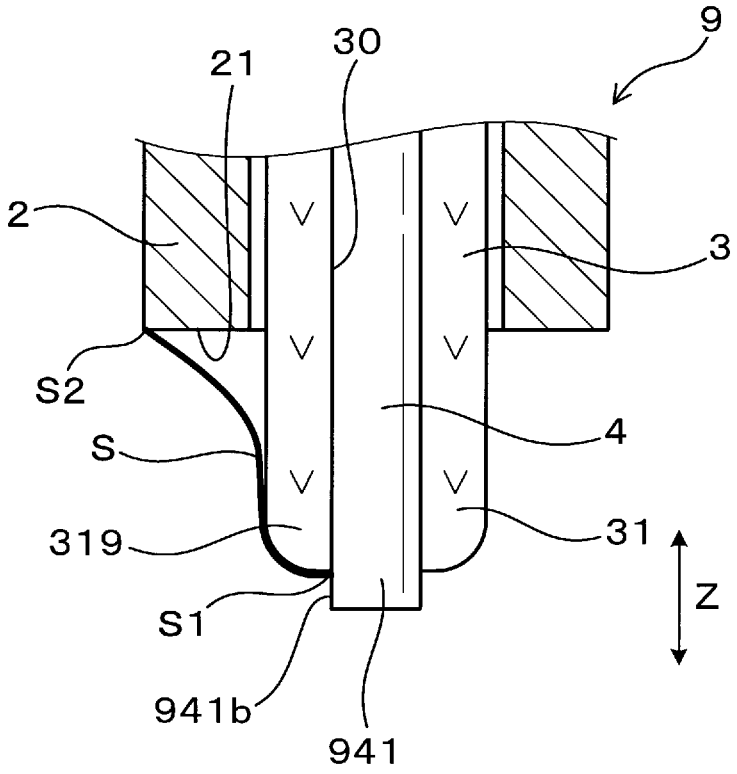
FIG. 10 is the enlarged sectional view of the periphery of the tip end portion of the spark plug in the comparative form for describing a state in which the discharge spark is extended by the air flow.

Next, as illustrated in FIGS. 9 and 10, a structure of a spark plug 9 not having either of a first part or a second part at the center electrode 4 will be first described, and subsequently, a discharge state will be described.

A spark plug 9 has a circular columnar center electrode protruding portion 941 protruding to the tip end side of an insulator protruding portion 31. The center electrode protruding portion 941 is in a circular columnar shape. As viewed in the plug axial direction Z, the center electrode protruding portion 941 is inside a through-hole 30 of an insulator 3. An outer peripheral surface 941*b* of the center electrode protruding portion 941 is formed in the plug axial direction Z. Moreover, a corner portion 319 at the tip end of the insulator protruding portion 31 of the insulator 3 is formed in a gentle curved shape.

As illustrated in FIG. 9, at the spark plug 9, discharge is generated starting, as the points of origin, from the inner peripheral end of a tip end surface 21 of a ground electrode 2 and an outer peripheral surface 941*b* of the center electrode protruding portion 941 of a center electrode 4. Moreover, a part between both points of origin of the discharge spark S generated by such discharge is formed along the surface of the insulator protruding portion 31. In this state, the part between both points of origin of the discharge spark S is formed at least on the corner portion 319 at the tip end of the insulator protruding portion 31.

Then, as illustrated in FIGS. 9 and 10, the point S2 of origin of the discharge spark S on the ground electrode 2 side is, in the combustion chamber of the internal combustion engine attached to the spark plug 9, extended by the air flow F flowing in the direction perpendicular to the plug axial direction Z, and moves toward the outer peripheral side in the plug radial direction on the tip end surface 21 of the ground electrode 2.

Meanwhile, while the point S2 of origin of the discharge spark S on the ground electrode 2 side is moving as illustrated in FIGS. 9 and 10, the point S1 of origin of the discharge spark S on the center electrode 4 side hardly moves from an initial position. That is, the point S1 of origin of the discharge spark S on the center electrode 4 side does not move in a direction apart from the surface of the insulator protruding portion 31. This is because the outer peripheral surface 941*b* of the center electrode protruding portion 941 is formed in the plug axial direction Z, and therefore, the point S1 of origin of the discharge spark S on the center electrode 4 side cannot move to the outer peripheral side in the plug radial direction on the outer peripheral surface 941*b* of the center electrode protruding portion 941.

Thus, the part between both points of origin of the discharge spark S less moves apart from the corner portion 319 at the tip end of the insulator protruding portion 31. Accordingly, even when the discharge spark S is extended by the air flow F, the part between both points of origin is less easily greatly extended to the downstream side. Thus, the spark plug 9 described here is worse than the spark plug 1 of the present embodiment in terms of the performance of ignition of the air-fuel mixture in the combustion chamber.

Moreover, the spatial distance between the second part 412 of the center electrode 4 and the ground electrode 2 in the spark plug 1 is constant along the entire circumference. Thus, concentration of discharge generated between the second part 412 of the center electrode 4 and the ground electrode 2 on a position shifted to one side in the plug circumferential direction can be prevented. Thus, at the insulator 3, promotion of wearing of the insulator 3 due to concentration of channeling on the position shifted to one side in the plug circumferential direction can be prevented.

Moreover, the radial gap rc is formed between the outer peripheral surface 31*b* of the insulator protruding portion 31 and the inner peripheral surface 412*b* of the second part 412 of the center electrode 4 in the plug radial direction. Thus, the air flow in the combustion chamber also flows into the radial gap rc. Then, the air flow having flowed into the radial gap rc flows out toward the outside in the plug radial direction, i.e., a side apart from the insulator exposed portion 310, between the center electrode 4 and the ground electrode 2. Thus, the discharge spark is easily extended away from the insulator exposed portion 310.

As described above, according to the present embodiment, the internal combustion engine spark plug configured so that the performance of ignition of the air-fuel mixture can be improved can be provided.

Second Embodiment

Figure 11:
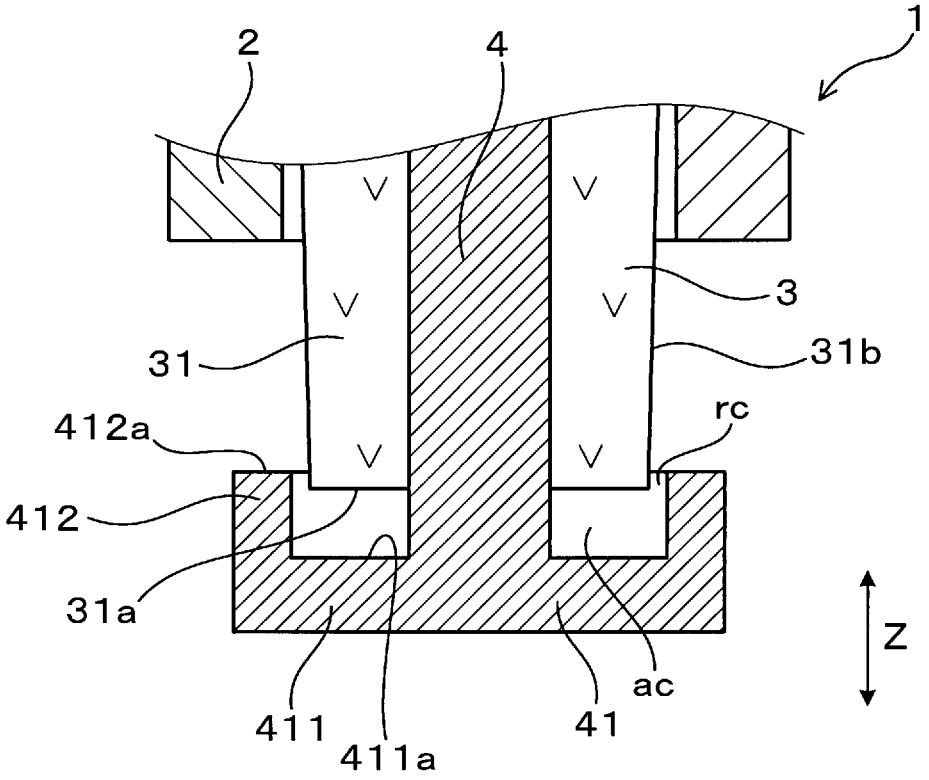
FIG. 11 is an enlarged sectional view of a periphery of a tip end portion of a spark plug in a second embodiment.

The present embodiment is an embodiment in which an axial gap ac is formed between a first part 411 and an insulator protruding portion 31 in a plug axial direction Z as illustrated in FIG. 11. That is, a tip end surface 31*a* of the insulator protruding portion 31 is formed at a position apart from an end surface 411*a* of the first part 411 on a base end side in the plug axial direction Z toward the base end side. Meanwhile, the tip end surface 31*a* of the insulator protruding portion 31 is positioned on a tip end side in the plug axial direction Z with respect to an end surface 412*a* of a second part 412 on the base end side in the plug axial direction Z. Thus, a corner portion of the insulator protruding portion 31 is covered with the first part 411 and the second part 412 of a center electrode 4. The axial gap ac communicates with a radial gap rc.

Note that in the present embodiment, a diameter A is 4.55 mm, an inner diameter B is 4.85 mm, an outer diameter C is 5.85 mm, and a spatial distance D is 5.0 mm.

Other points are similar to those of the first embodiment.

Note that of reference numerals used in a second embodiment or later, the same reference numerals as those used in the already-described embodiment indicate components etc. similar to those of the already-described embodiment, unless otherwise stated.

In the present embodiment, an air flow in a combustion chamber also flows into the axial gap ac and the radial gap rc. Then, the air flow having flowed into the axial gap ac and the radial gap rc flows out toward the outside in a plug radial direction, i.e., toward a side apart from an insulator exposed portion 310, between the center electrode 4 and a ground electrode 2. Thus, the discharge spark is easily extended away from the insulator exposed portion 310.

Moreover, due to a difference between the linear coefficient of expansion of an insulator 3 and the linear coefficient of expansion of the center electrode 4, thermal stress generated at the insulator 3 and the center electrode 4 can be reduced.

On other points, features and advantageous effects similar to those of the first embodiment are provided.

Third Embodiment

Figure 12:
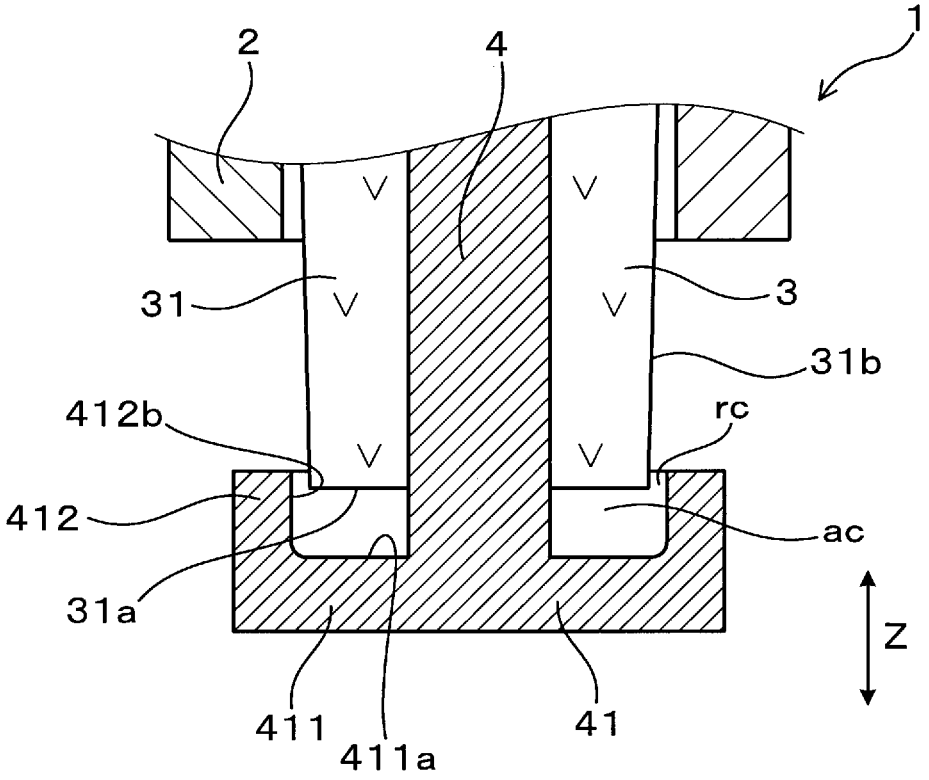
FIG. 12 is an enlarged sectional view of a periphery of a tip end portion of a spark plug in a third embodiment.

The present embodiment is an embodiment in which the shape of an end surface 411*a* of a first part 411 on a base end side in a plug axial direction Z and the shape of an inner peripheral surface 412*b* of a second part 412 are changed from those of the second embodiment as illustrated in FIG. 12. That is, in the present embodiment, the end surface 411*a* of the first part 411 and the inner peripheral surface 412*b* of the second part 412 are smoothly connected to each other in a curved surface shape. In the present embodiment, the radius of curvature of the curved surface between the end surface 411*a* of the first part 411 and the inner peripheral surface 412*b* of the second part 412 is 0.5 mm.

Other points are similar to those of the second embodiment.

In the present embodiment, an air flow having flowed into an axial gap ac and a radial gap rc can be smoothly sent out to between a center electrode 4 and a ground electrode 2. Thus, less turbulence is caused in the air flow flowing out from the axial gap ac and the radial gap rc, and the discharge spark is much more easily extended.

On other points, features and advantageous effects similar to those of the second embodiment are provided.

Fourth Embodiment

Figure 13:
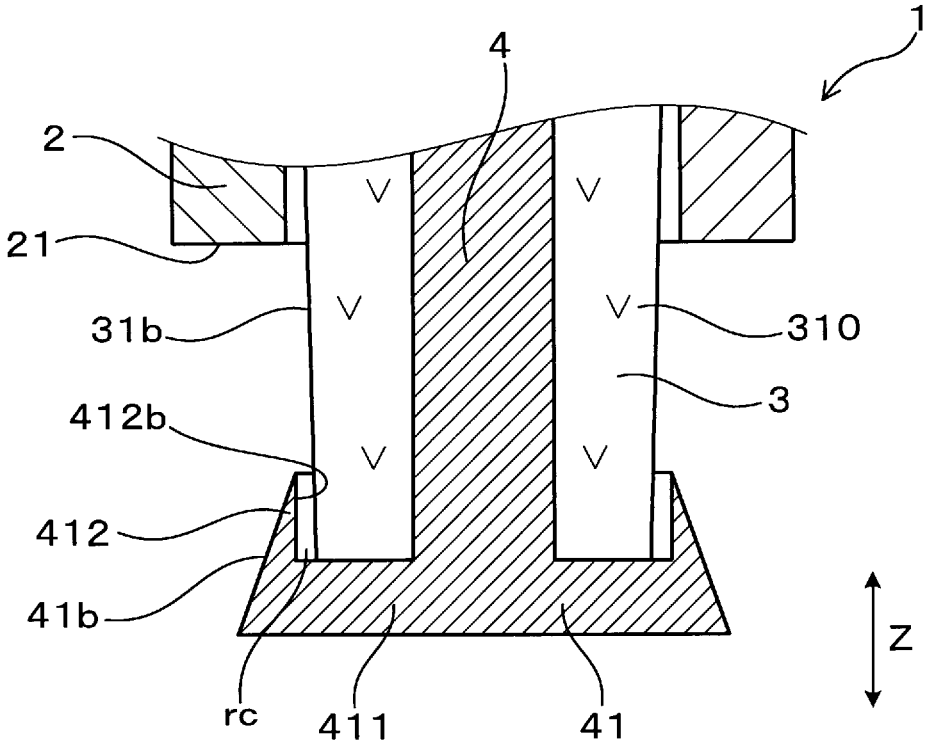
FIG. 13 is an enlarged sectional view of a periphery of a tip end portion of a spark plug in a fourth embodiment.
Figure 14:
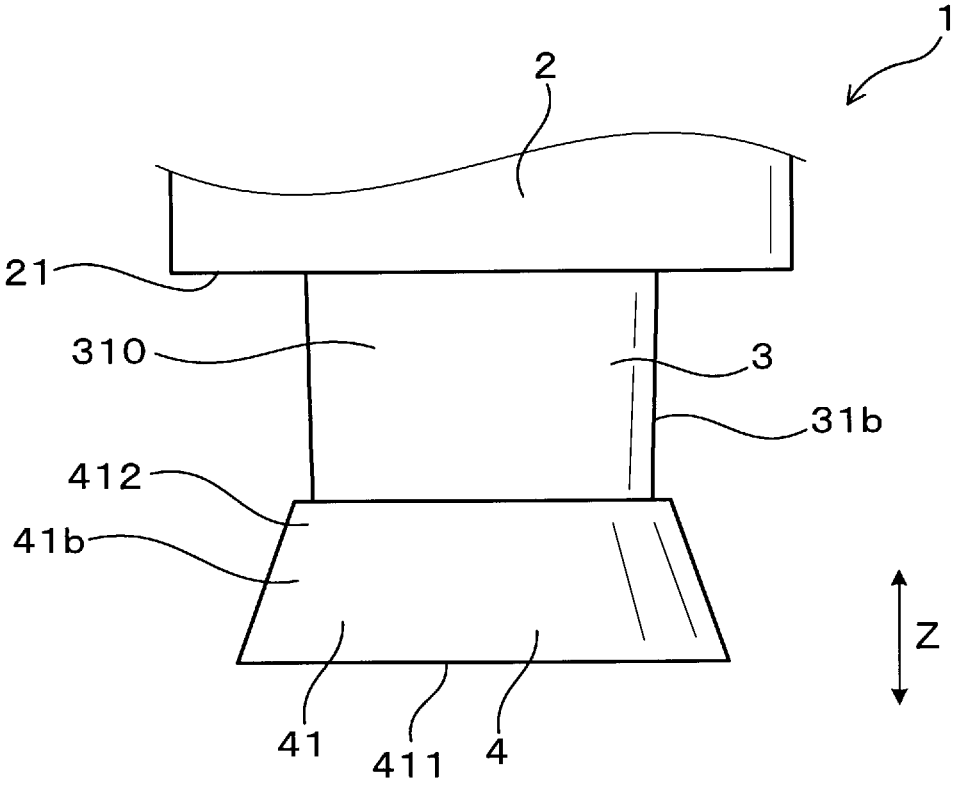
FIG. 14 is an enlarged side view of the periphery of the tip end portion of the spark plug in the fourth embodiment.

The present embodiment is an embodiment in which the shape of an exposed portion 41 is changed from that of the first embodiment as illustrated in FIGS. 13 and 14. An outer peripheral surface 41*b* of an exposed portion 41 has a part inclined toward an outer peripheral side in a plug radial direction as extending toward a tip end side in a plug axial direction Z. In the present embodiment, the entirety of the outer peripheral surface 41*b* of the exposed portion 41 is inclined toward the outer peripheral side in the plug radial direction as extending toward the tip end side in the plug axial direction Z. That is, the outer shape of the exposed portion 41 is diameter-narrowed toward a base end side in the plug axial direction Z. Moreover, as illustrated in FIG. 13, the angle of a corner portion between the outer peripheral surface 41*b* of the exposed portion 41 and the inner peripheral surface 412*b* of the second part 412 is provided. Note that in the present embodiment, the length of the outer peripheral surface 41*b* of the exposed portion 41 in the plug axial direction Z is 2.0 mm. Moreover, the length of each of a diameter A, an inner diameter B, an outer diameter C, and a spatial distance D is similar to that of the second embodiment.

Other points are similar to those of the first embodiment.

In the present embodiment, by an air flow in a combustion chamber of an internal combustion engine attached to a spark plug 1, discharge generated between a center electrode 4 and a ground electrode 2 is easily detached from a surface of an insulator exposed portion 310, and is easily greatly extended to a downstream side of the air flow. This will be described later with reference to FIGS. 15 to 16.

Figure 15:
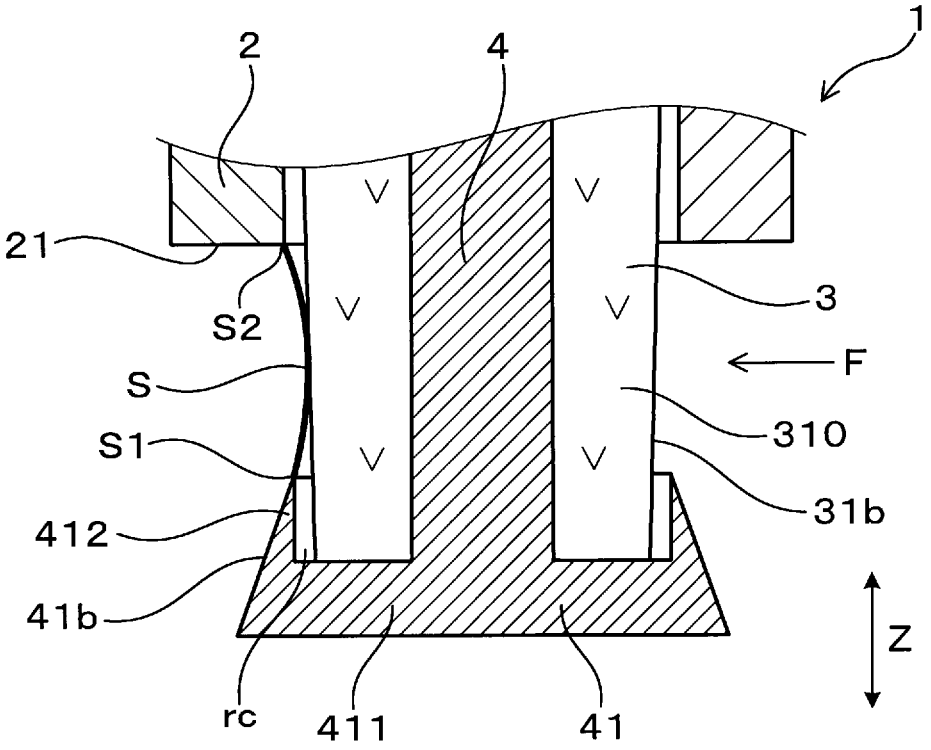
FIG. 15 is an enlarged sectional view of the periphery of the tip end portion of the spark plug in the fourth embodiment for describing initial discharge spark.
Figure 16:
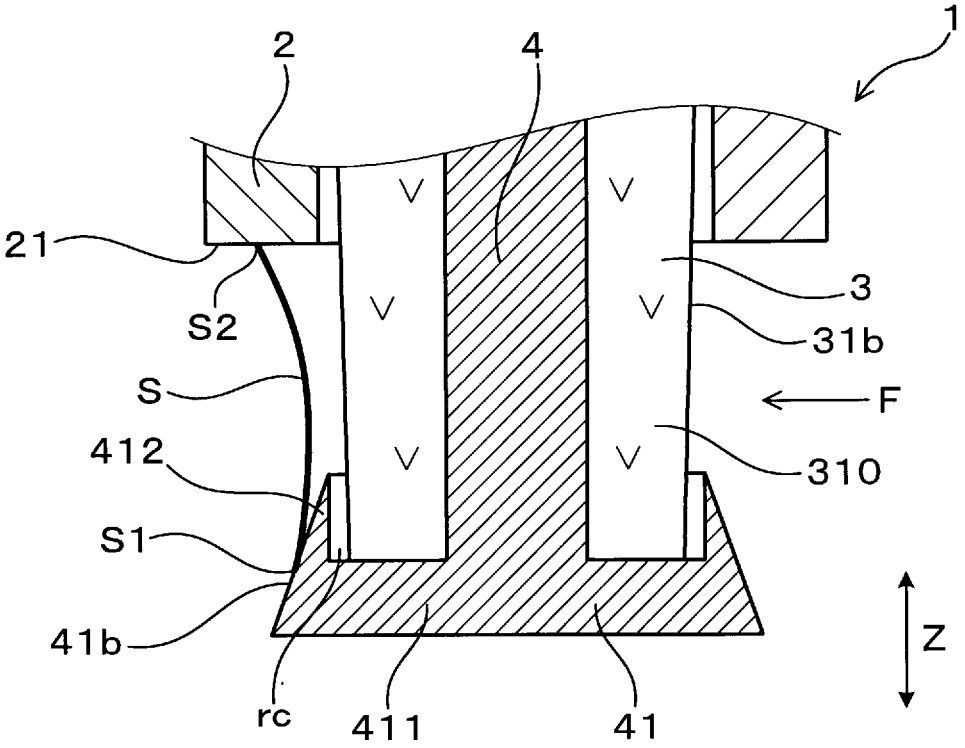
FIG. 16 is an enlarged sectional view of the periphery of the tip end portion of the spark plug in the fourth embodiment for describing a state in which the discharge spark is extended by an air flow and moves apart from a surface of an insulator protruding portion.
Figure 17:
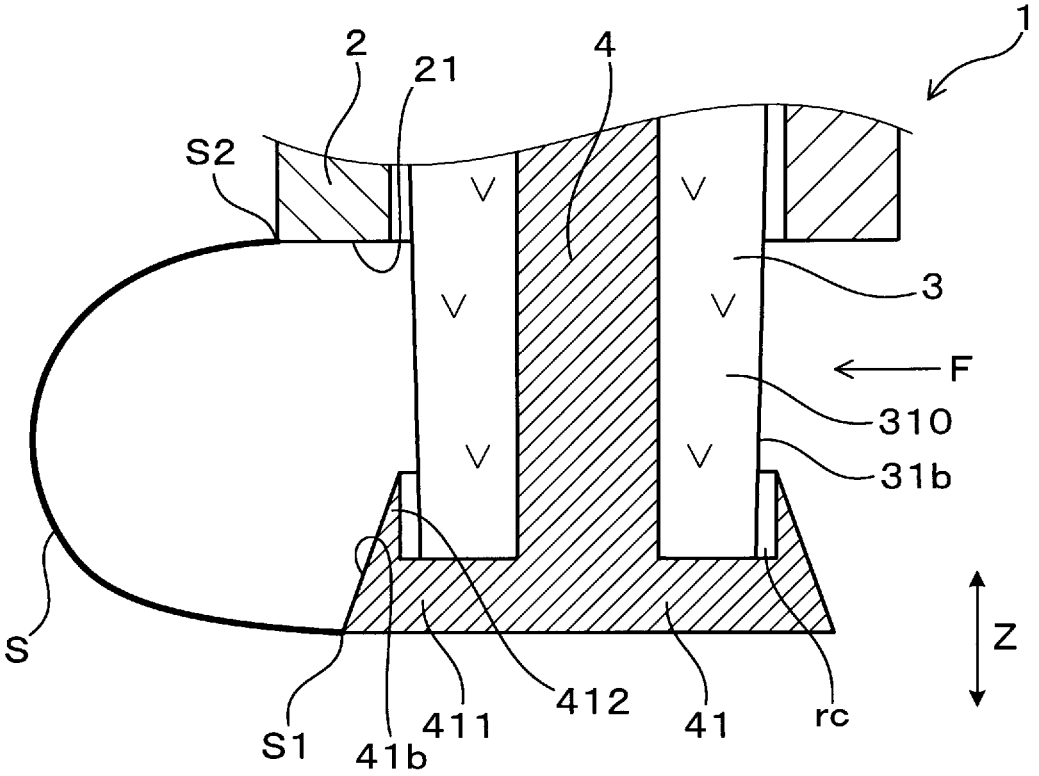
FIG. 17 is an enlarged sectional view of the periphery of the tip end portion of the spark plug in the fourth embodiment for describing a state in which the discharge spark is extended by the air flow and is greatly extended.

As illustrated in FIG. 15, in the present embodiment, the point S1 of origin of the discharge spark S on a center electrode 4 side is generated at the corner of an end portion of the second part 412 on the base end side in the plug axial direction Z. Moreover, as illustrated in FIGS. 16 and 17, the point S1 of origin of the discharge spark S on the center electrode 4 side is extended by an air flow F flowing in a direction perpendicular to the plug axial direction Z in the combustion chamber, and on the outer peripheral surface 41*b* of the exposed portion 41, moves toward the tip end side in the plug axial direction Z and the outer peripheral side in the plug radial direction. Note that in this state, the point S2 of origin of the discharge spark S on a ground electrode 2 side moves, as in the first embodiment, toward the outer peripheral side in the plug radial direction on a tip end surface 21 of the ground electrode 2. Thus, both points of origin of the discharge spark S move in a direction apart from the insulator exposed portion 310 in the plug radial direction, and move such that a distance between both points of origin of the discharge spark S is increased in the plug axial direction Z.

In association with movement of both points of origin of the discharge spark S in the direction apart from the insulator exposed portion 310 in the plug radial direction, a part between both points of origin of the discharge spark S also moves apart from an outer peripheral surface of the insulator exposed portion 310 toward the outer peripheral side. Then, the part, which has moved apart from the outer peripheral surface of the insulator exposed portion 310 toward the outer peripheral side, between both points of origin of the discharge spark S is greatly extended toward a downstream side of the air flow F by the air flow F in the combustion chamber. Specifically, in the present embodiment, both points of origin of the discharge spark S move such that the distance between both points of origin of the discharge spark S in the plug axial direction Z is increased, and therefore, the part between both points of origin of the discharge spark S is much more easily greatly extended. Thus, the area of contact between the discharge spark S and an air-fuel mixture is much more easily earned, and performance of ignition of the air-fuel mixture is much more easily ensured.

On other points, features and advantageous effects similar to those of the first embodiment are provided.

Fifth Embodiment

Figure 18:
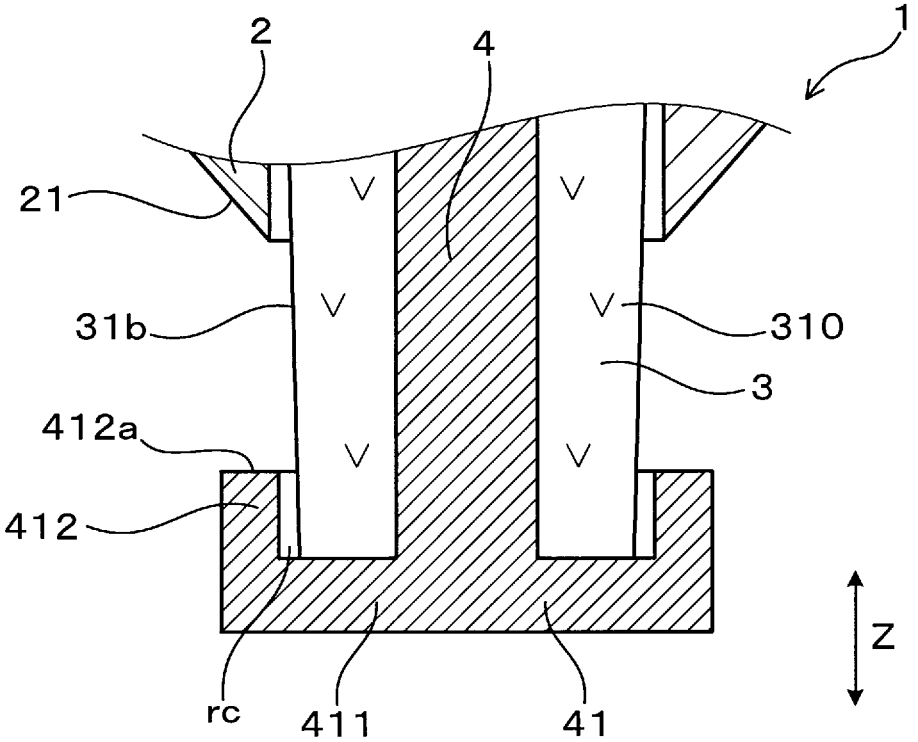
FIG. 18 is an enlarged sectional view of a periphery of a tip end portion of a spark plug in a fifth embodiment.
Figure 19:
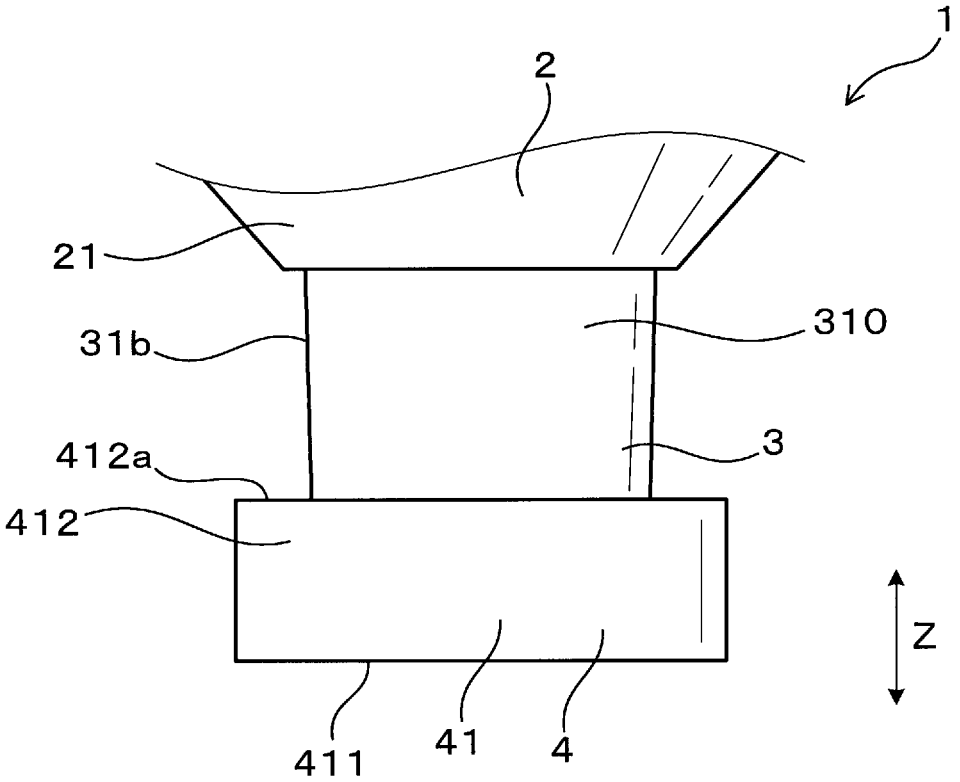
FIG. 19 is an enlarged side view of the periphery of the tip end portion of the spark plug in the fifth embodiment.

The present embodiment is an embodiment in which the shape of a ground electrode 2 is changed from that of the first embodiment as illustrated in FIGS. 18 and 19. A tip end surface 21 of the ground electrode 2 has a part inclined toward a base end side in a plug axial direction Z as extending toward an outer peripheral side in a plug radial direction. In the present embodiment, the entirety of the tip end surface 21 of the ground electrode 2 is inclined toward the base end side in the plug axial direction Z as extending toward the outer peripheral side in the plug radial direction. The angle of a corner portion between the tip end surface 21 and an inner peripheral surface of the ground electrode 2 is an obtuse angle. Note that the length of each of a diameter A, an inner diameter B, an outer diameter C, and a spatial distance D is similar to that of the second embodiment.

Other points are similar to those of the first embodiment.

In the present embodiment, discharge generated between a center electrode 4 and the ground electrode 2 is, by an air flow in a combustion chamber of an internal combustion engine attached to a spark plug 1, easily detached from a surface of an insulator exposed portion 310, and is easily greatly extended to a downstream side of the air flow. This will be described later with reference to FIGS. 20 to 22.

Figure 20:
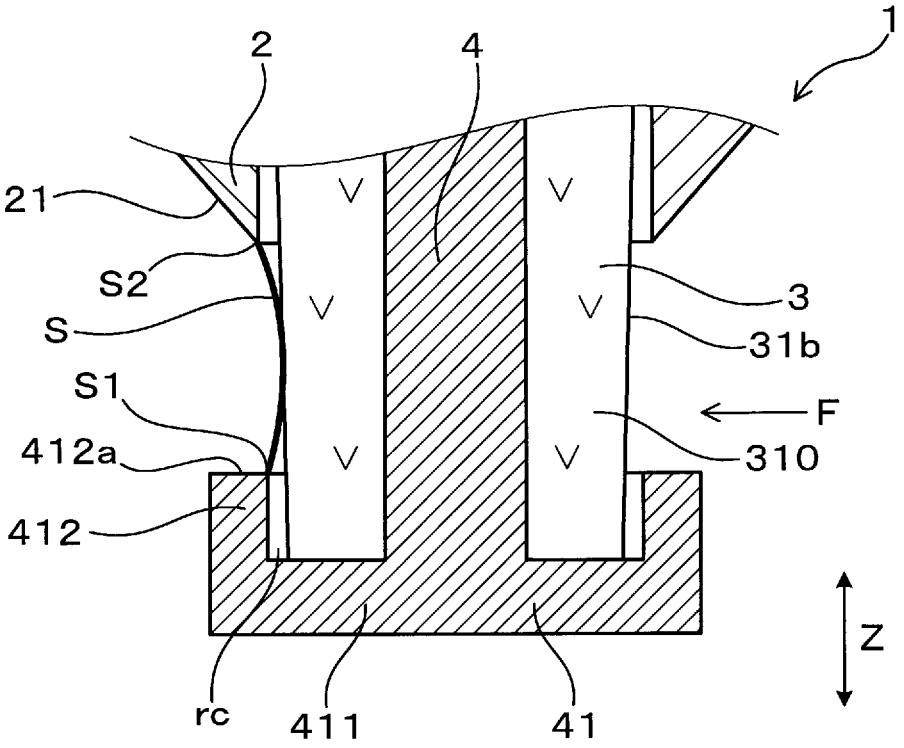
FIG. 20 is the enlarged sectional view of the periphery of the tip end portion of the spark plug in the fifth embodiment for describing initial discharge spark.
Figure 21:
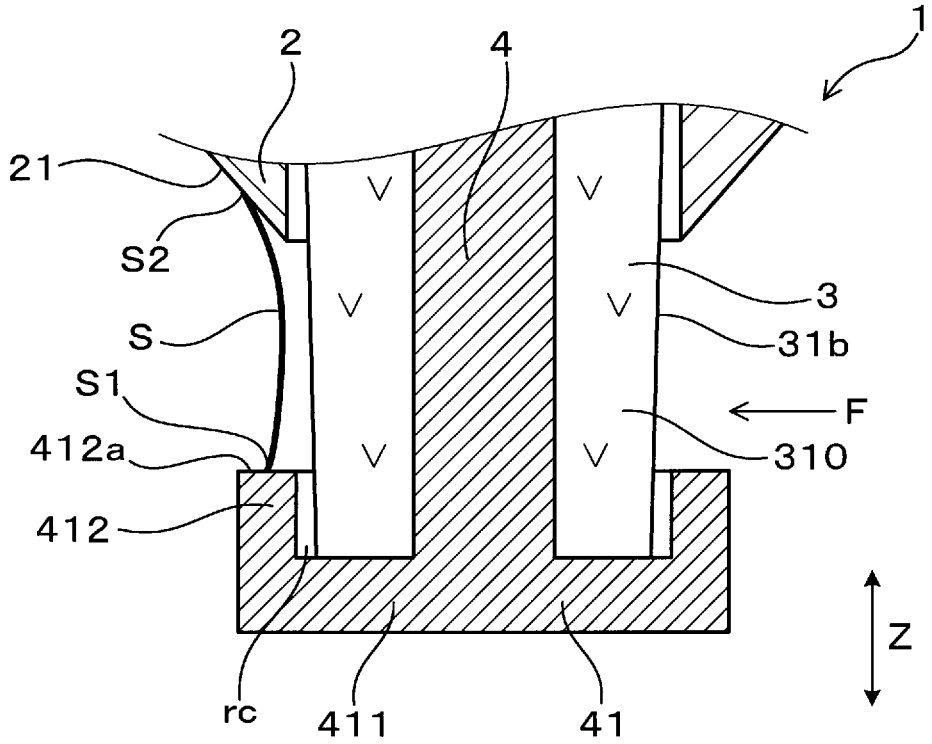
FIG. 21 is the enlarged sectional view of the periphery of the tip end portion of the spark plug in the fifth embodiment for describing a state in which the discharge spark is extended by an air flow and moves apart from a surface of an insulator protruding portion.
Figure 22:
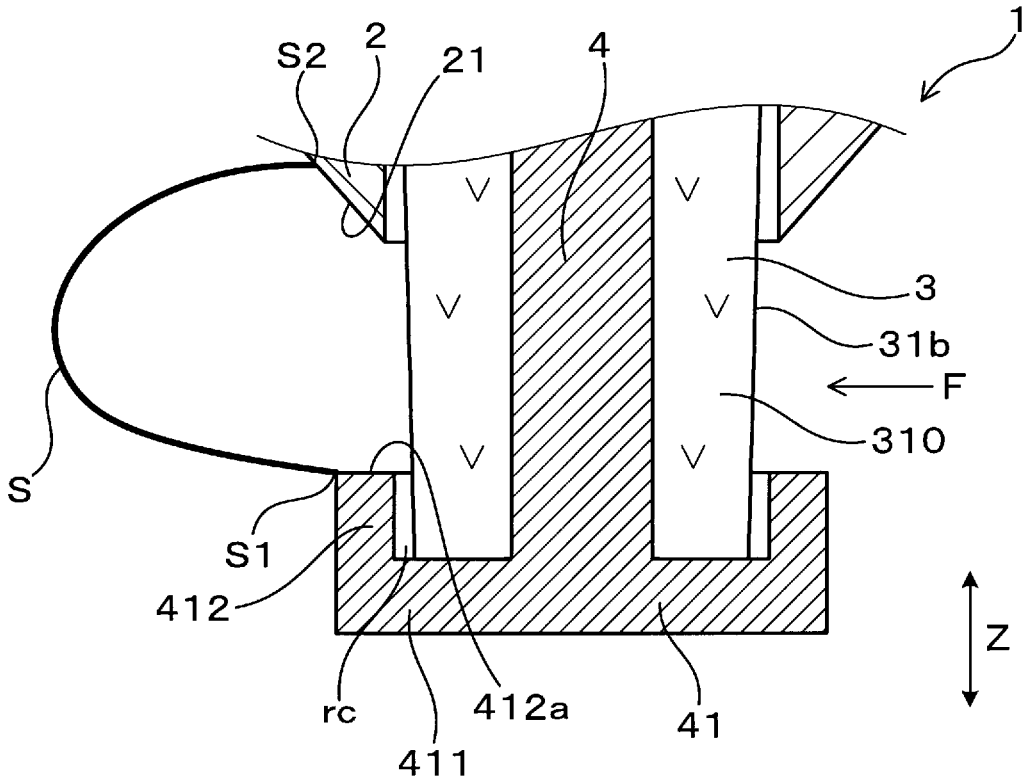
FIG. 22 is the enlarged sectional view of the periphery of the tip end portion of the spark plug in the fifth embodiment for describing a state in which the discharge spark is extended by the air flow and is greatly extended.

As illustrated in FIG. 20, in the present embodiment, the point S2 of origin of the discharge spark S on a ground electrode 2 side is generated starting, as the point of origin, from an inner peripheral end corner of the tip end surface 21 of the ground electrode 2. Then, as illustrated in FIGS. 21 and 22, the point S2 of origin of the discharge spark S on the ground electrode 2 side is extended by an air flow F flowing in a direction perpendicular to the plug axial direction Z in the combustion chamber, and on the tip end surface 21 of the ground electrode 2, moves toward the base end side in the plug axial direction Z and the outer peripheral side in the plug radial direction. Note that as in the first embodiment, the point S1 of origin of the discharge spark S on a center electrode 4 side moves toward the outer peripheral side in the plug radial direction on an end surface 412*a* of a second part 412 on the base end side in the plug axial direction Z. Accordingly, both points of origin of the discharge spark S move in a direction apart from the insulator exposed portion 310 in the plug radial direction, and move such that a distance between both points of origin of the discharge spark S is increased in the plug axial direction Z.

In association with movement of both points of origin of the discharge spark S in the direction apart from the insulator exposed portion 310 in the plug radial direction, a part between both points of origin of the discharge spark S also moves apart from an outer peripheral surface of the insulator exposed portion toward the outer peripheral side. Then, the part, which has moved apart from the outer peripheral surface of the insulator exposed portion 310 toward the outer peripheral side, between both points of origin of the discharge spark S is greatly extended toward the downstream side of the air flow by the air flow in the combustion engine. Specifically, in the present embodiment, both points of origin of the discharge spark S move such that the distance in the plug axial direction Z between both points of origin of the discharge spark S is increased, and therefore, the part between both points of origin of the discharge spark S is much more easily greatly extended. Thus, the area of contact between the discharge spark S and an air-fuel mixture is much more easily earned, and performance of ignition of the air-fuel mixture is much more easily ensured.

On other points, features and advantageous effects similar to those of the first embodiment are provided.

Sixth Embodiment

Figure 23:
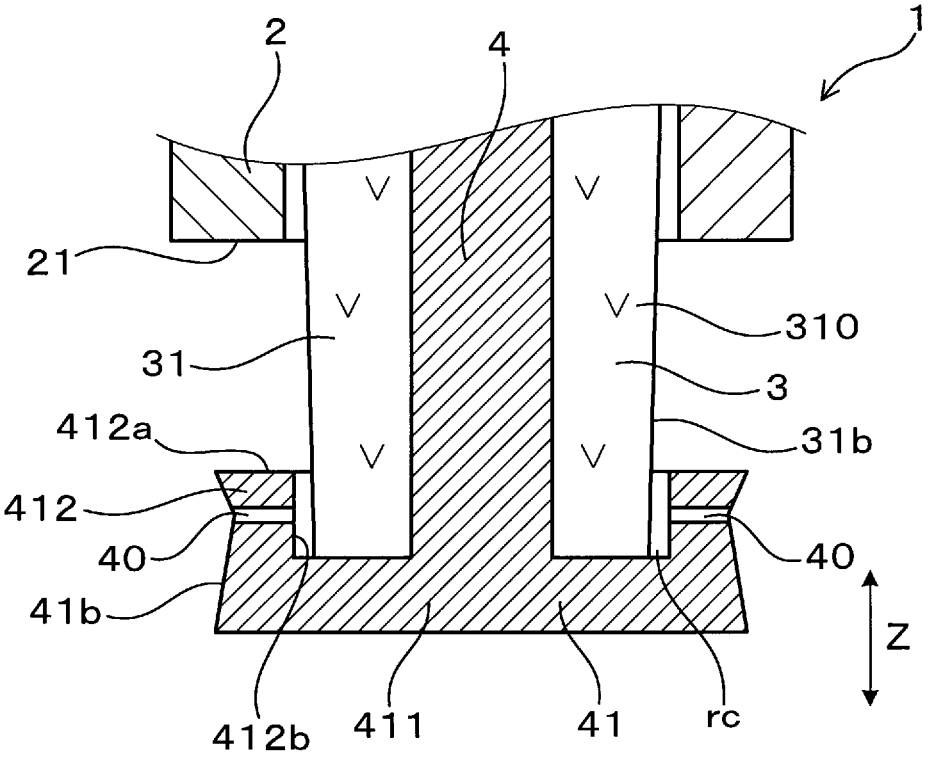
FIG. 23 is an enlarged sectional view of a periphery of a tip end portion of a spark plug in a sixth embodiment.
Figure 24:
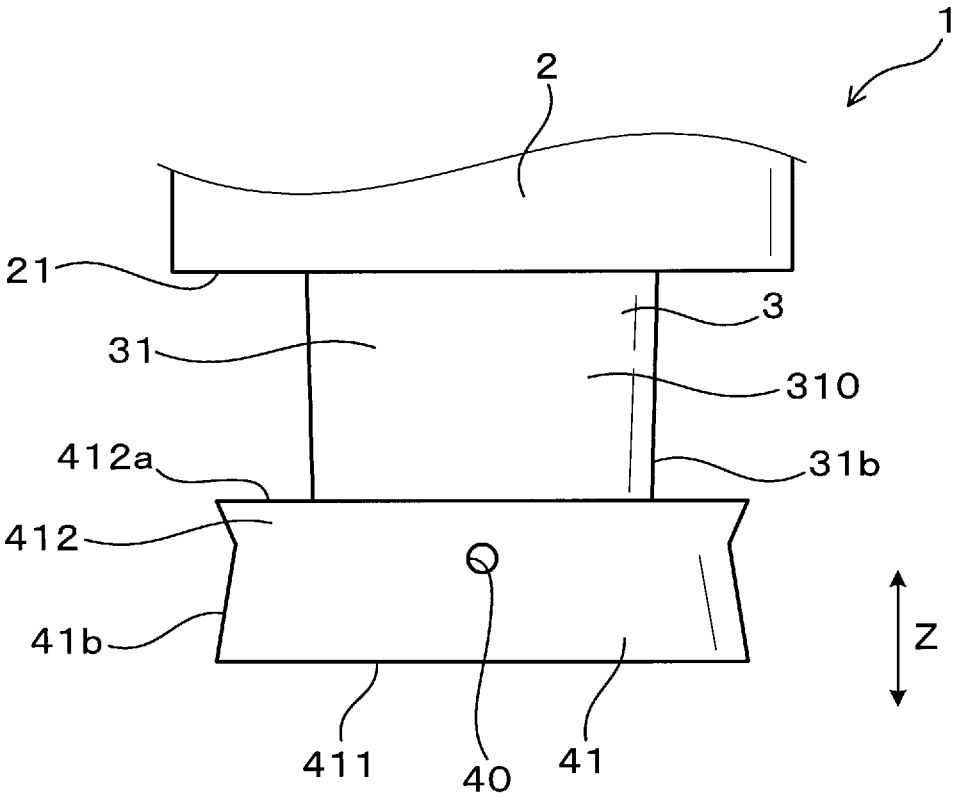
FIG. 24 is an enlarged side view of the periphery of the tip end portion of the spark plug in the sixth embodiment.
Figure 25:
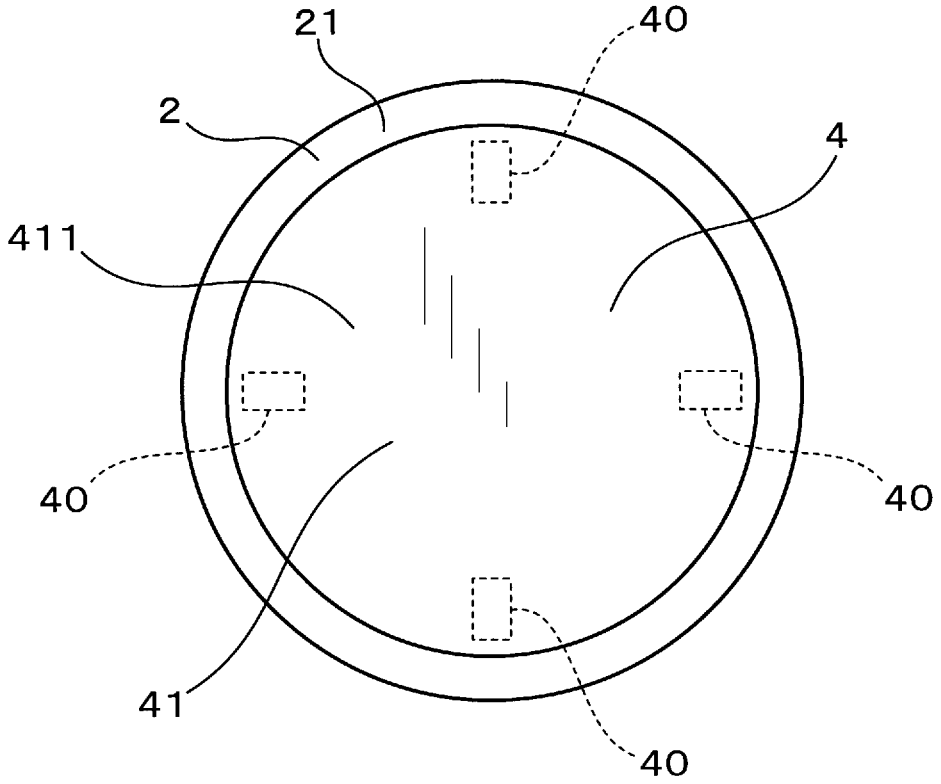
FIG. 25 is a view of a center electrode and a ground electrode from a tip end side in a plug axial direction in the sixth embodiment.

The present embodiment is an embodiment in which ventilation holes 40 penetrating an exposed portion 41 from the outside to the inside are formed at the exposed portion 41 as illustrated in FIGS. 23 to 25. The ventilation hole 40 opens, at one end thereof, to a radial gap rc. In the present embodiment, the ventilation holes 40 are formed at a second part 412 of a center electrode 4. As illustrated in FIG. 23, the ventilation holes 40 are formed to penetrate the second part 412 in a plug radial direction. The other end of the ventilation hole 40 opens toward an outer peripheral side of an outer peripheral surface 41*b* of the exposed portion 41.

As illustrated in FIG. 25, in the present embodiment, multiple ventilation holes 40, specifically four ventilation holes 40, are formed. Four ventilation holes 40 are arranged at equal intervals in a plug circumferential direction. That is, four ventilation holes 40 are formed at four spots in the plug circumferential direction at an interval of 90°. Note that in FIG. 25, the positions of the outer shapes of the ventilation holes 40 as viewed in a plug axial direction Z are indicated by dashed lines.

As illustrated in FIGS. 23 and 24, the outer peripheral surface 41*b* of the exposed portion 41 has a shape recessed toward an inner peripheral side. Specifically, the outer peripheral surface 41*b* of the exposed portion 41 is recessed to extend toward an outer peripheral side in the plug radial direction as extending apart from the ventilation hole 40 in the plug axial direction Z. That is, the outer peripheral surface 41*b* of the exposed portion 41 is configured such that a part provided with the ventilation hole 40 has the smallest diameter. Note that the length of each of a diameter A, an inner diameter B, an outer diameter C, and a spatial distance D is similar to that of the second embodiment.

Other points are similar to those of the first embodiment.

In the present embodiment, an air flow is, between the center electrode 4 and a ground electrode 2, easily generated toward the outside in the plug radial direction, i.e., a side apart from a surface of an insulator exposed portion 310. That is, in the present embodiment, part of the air flow in a combustion chamber first flows into a radial gap rc from the outside of a spark plug 1 through the ventilation holes 40. Then, the air flow having flowed into the radial gap rc flows out toward the outer peripheral side in the plug radial direction, i.e., the side apart from the insulator exposed portion 310, between the center electrode 4 and the ground electrode 2. Thus, the discharge spark is much more easily extended.

On other points, features and advantageous effects similar to those of the first embodiment are provided.

Seventh Embodiment

Figure 26:
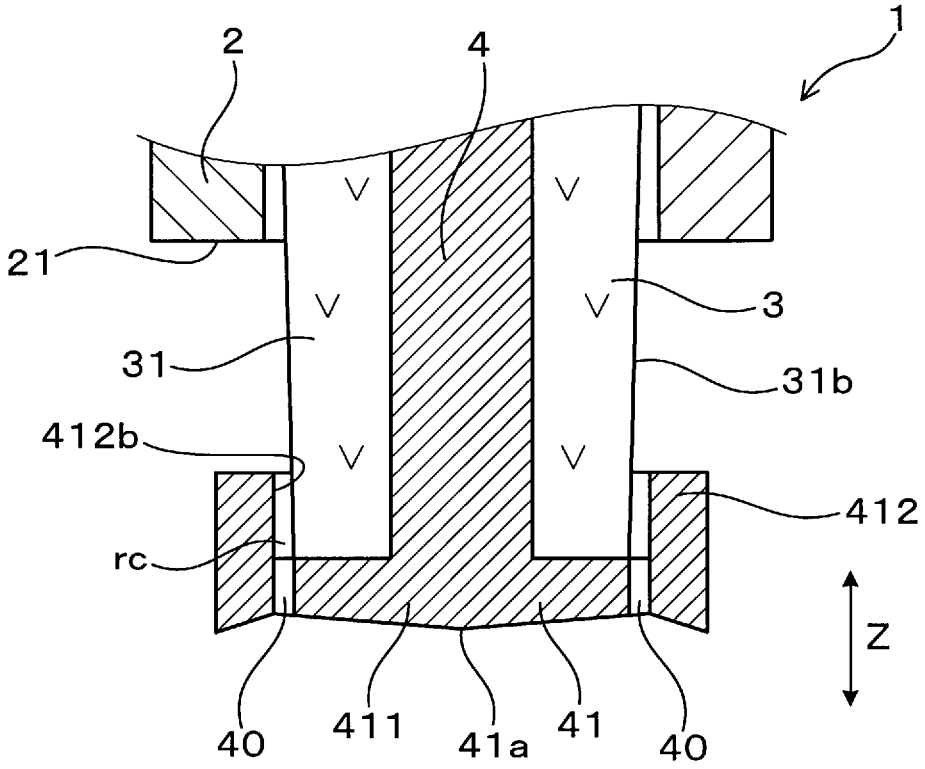
FIG. 26 is an enlarged sectional view of a periphery of a tip end portion of a spark plug in a seventh embodiment.
Figure 27:
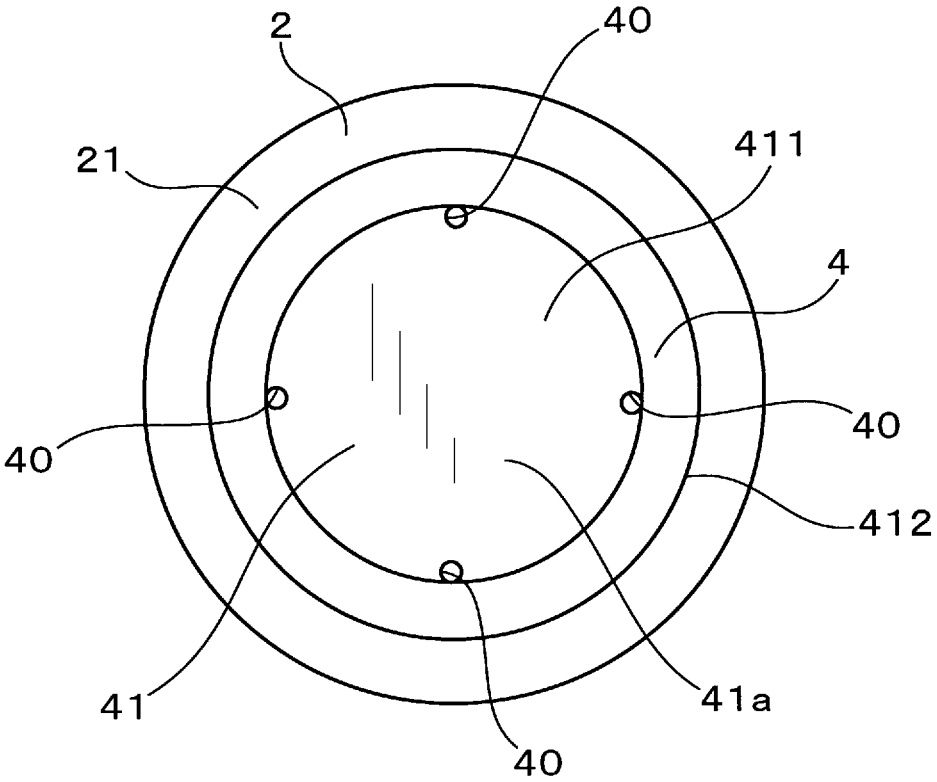
FIG. 27 is a view of a center electrode and a ground electrode viewed from a tip end side in a plug axial direction in the seventh embodiment.

The present embodiment is an embodiment in which ventilation holes 40 are formed at a first part 411 of a center electrode 4 as illustrated in FIGS. 26 and 27. As illustrated in FIG. 26, the ventilation hole 40 is formed to penetrate the first part 411 in a plug axial direction Z. One end of the ventilation hole 40 opens toward a space between an outer peripheral surface 31*b* of an insulator protruding portion 31 and an inner peripheral surface 412*b* of a second part 412 of an exposed portion 41 of the center electrode 4. The other end of the ventilation hole 40 opens to a tip end side of the first part 411 in the plug axial direction Z.

As illustrated in FIG. 27, in the present embodiment, multiple ventilation holes 40, specifically four ventilation holes 40, are also formed. Four ventilation holes 40 are arranged at equal intervals in a plug circumferential direction. That is, four ventilation holes 40 are formed at four spots in the plug circumferential direction at an interval of 90°.

As illustrated in FIG. 26, an end surface 41*a* of the exposed portion 41 on the tip end side in the plug axial direction Z is formed in a recessed-raised shape. The end surface 41*a* of the exposed portion 41 is formed in such a recessed-raised shape that the end surface 41*a* protrudes to the tip end side in the plug axial direction Z as extending apart from the ventilation holes 40 in a plug radial direction. That is, the end surface 41*a* of the exposed portion 41 is recessed such that a part provided with the ventilation hole 40 is positioned on the most base end side in the plug axial direction Z.

Other points are similar to those of the sixth embodiment.

In the present embodiment, features and advantageous effects similar to those of the sixth embodiment are provided.

Eighth Embodiment

Figure 28:
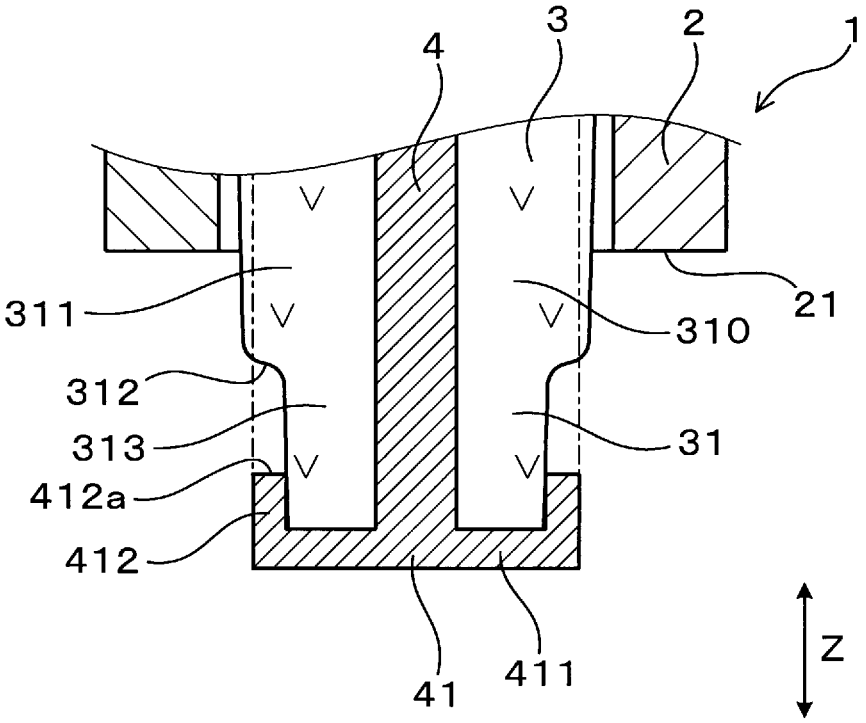
FIG. 28 is an enlarged sectional view of a periphery of a tip end portion of a spark plug in an eighth embodiment.
Figure 29:
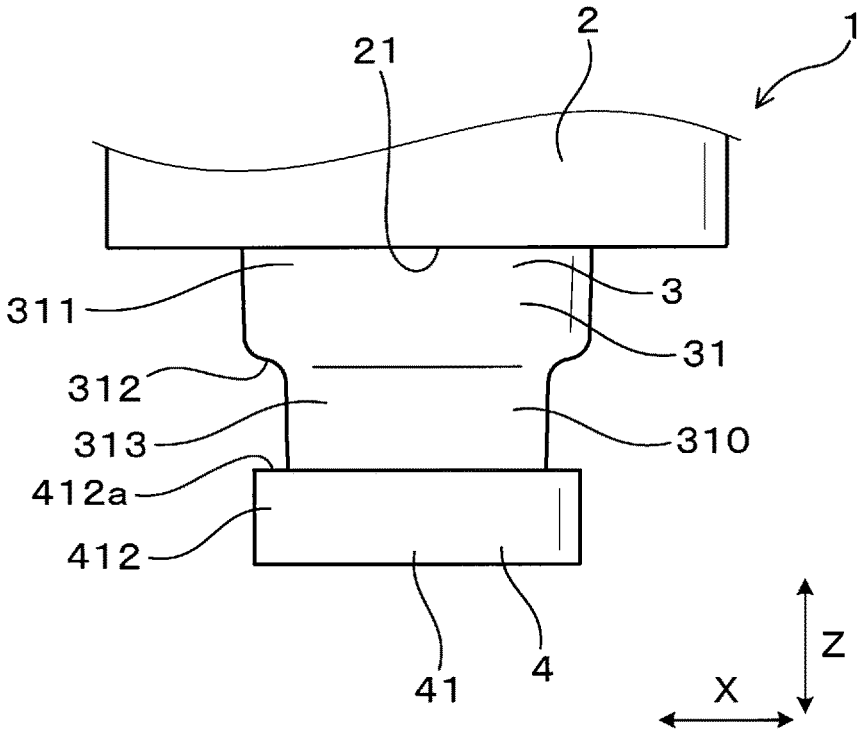
FIG. 29 is an enlarged side view of the periphery of the tip end portion of the spark plug in the eighth embodiment.
Figure 30:
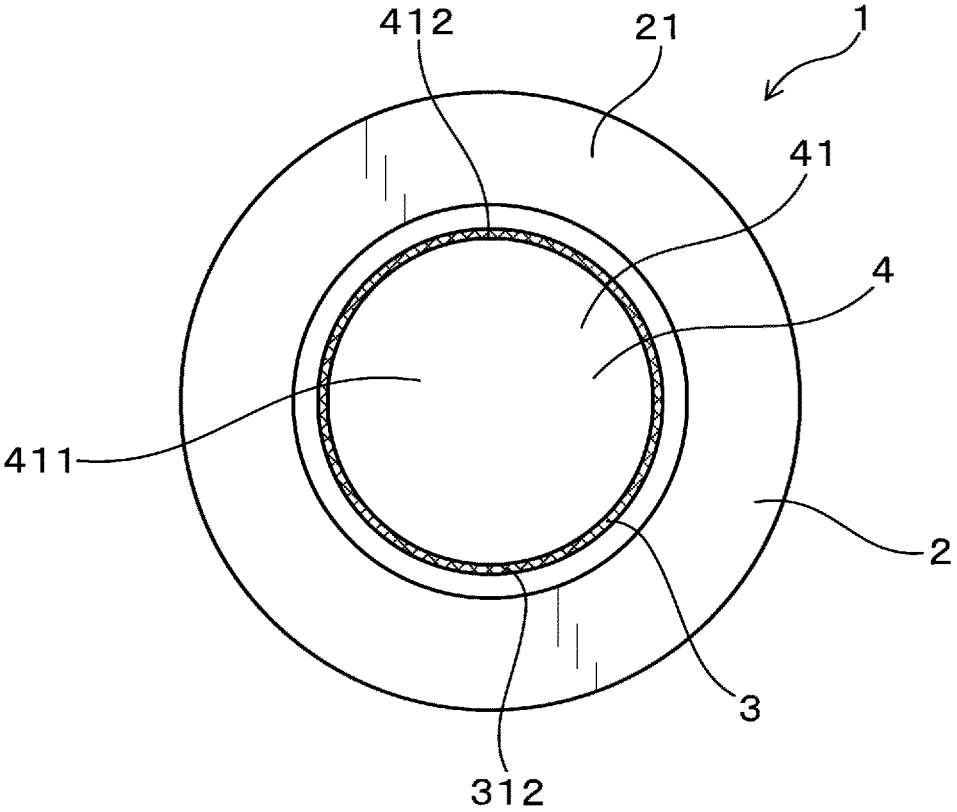
FIG. 30 is a view of a center electrode, an insulator, and a ground electrode viewed from a tip end side in a plug axial direction in the eighth embodiment.

The present embodiment is an embodiment in which the shape of an insulator protruding portion 31 is changed from that of the first embodiment as illustrated in FIGS. 28 to 30.

As illustrated in FIGS. 28 and 29, the insulator protruding portion 31 has an insulator step portion 312 having a smaller diameter on a tip end side in a plug axial direction Z than on a base end side. Moreover, the insulator protruding portion 31 has, as a whole, such a step shape that an outer diameter decreases in a stepwise manner toward the tip end side in the plug axial direction Z. Accordingly, the insulator exposed portion 310 also has, as a whole, such a step shape that an outer diameter decreases in a stepwise manner toward the tip end side in the plug axial direction Z.

The insulator protruding portion 31 has an insulator large-diameter portion 311 formed on the base end side in the plug axial direction Z, an insulator small-diameter portion 313 formed on the tip end side of the insulator large-diameter portion 311, and the insulator step portion 312 coupling these portions. The outer diameter of the insulator small-diameter portion 313 is smaller than the outer diameter of the insulator large-diameter portion 311. The insulator step portion 312 is formed at the center of the insulator exposed portion 310 of the insulator protruding portion 31 in the plug axial direction Z. The insulator small-diameter portion 313, the insulator step portion 312, and the insulator large-diameter portion 311 at an outer peripheral surface of the insulator exposed portion 310 are connected to each other in a smooth curved shape. That is, a boundary between the insulator small-diameter portion 313 and the insulator step portion 312 and a boundary between the insulator step portion 312 and the insulator large-diameter portion 311 at the outer peripheral surface of the insulator exposed portion 310 do not define sharp corner portions. At the insulator protruding portion 31, the insulator step portion 312 is formed at a single spot in the plug axial direction Z. That is, the insulator protruding portion 31 in the present embodiment is in a single-step shape. The insulator step portion 312 is at a position on the base end side with respect to an end surface 412*a* of a second part 412 of a center electrode 4 on the base end side in the plug axial direction Z.

As illustrated in FIG. 28, the second part 412 is formed along an outer peripheral surface of the insulator small-diameter portion 313. Moreover, as illustrated in FIG. 30, an exposed portion 41 of the center electrode 4 is formed within a ground electrode 2 as viewed in the plug axial direction Z. That is, the maximum outer diameter of the exposed portion 41 of the center electrode 4 is smaller than the minimum inner diameter of the ground electrode 2. Note that the position of the outer shape of the exposed portion 41 when a sectional view of FIG. 28 is viewed in the plug axial direction Z is indicated by chain lines. FIG. 28 also shows that the outer shape position of the exposed portion 41 is within the ground electrode 2.

As illustrated in FIG. 30, in the present embodiment, the exposed portion 41 of the center electrode 4 is formed within not only the ground electrode 2 but also a housing (see a reference numeral 11 of FIG. 1) as viewed in the plug axial direction Z. Further, the exposed portion 41 of the center electrode 4 is formed within the outer shape of the insulator step portion 312 as viewed in the plug axial direction Z. Note that in FIG. 30, the insulator step portion 312 is hatched for the sake of convenience.

Other points are similar to those of the first embodiment.

Figure 31:
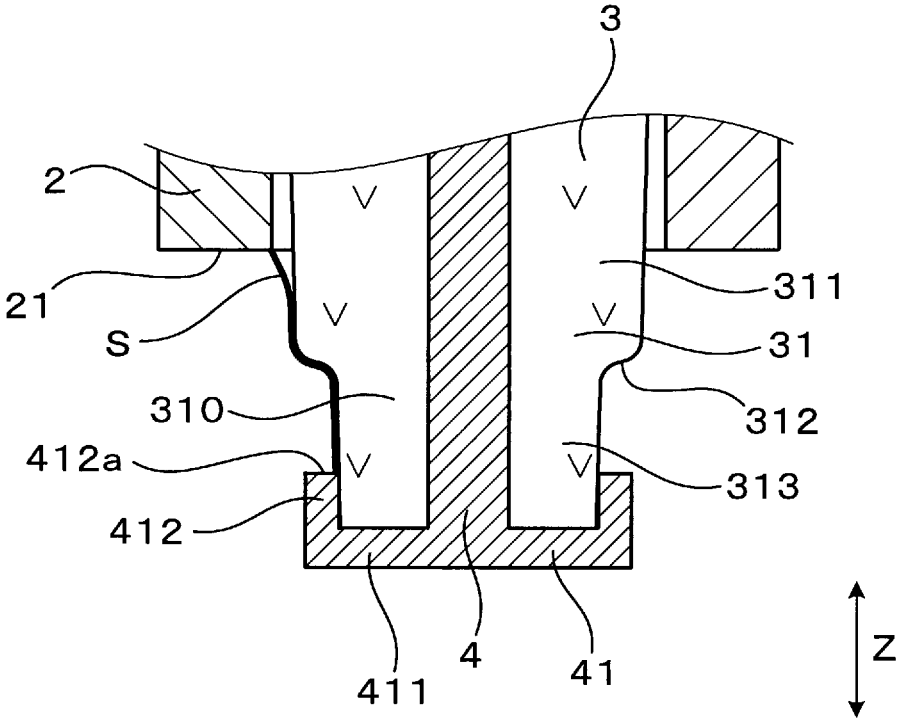
FIG. 31 is the enlarged sectional view of the periphery of the tip end portion of the spark plug in the eighth embodiment for describing initial discharge spark.

In the present embodiment, the insulator protruding portion 31 has, as a whole, such a step shape that the outer diameter decreases in a stepwise manner toward the tip end side in the plug axial direction Z. Thus, a path from the second part 412 to the ground electrode 2 along a surface of the insulator exposed portion 310 can be increased. Accordingly, a distance for creeping discharge can be ensured without extension of the insulator exposed portion 310 in the plug axial direction Z, and ignition performance can be enhanced. That is, as illustrated in FIG. 31, discharge is generated starting, as the points of origin, from an inner peripheral end of the end surface 412*a* of the second part 412 on the base end side in the plug axial direction Z and an inner peripheral end of a tip end surface 21 of the ground electrode 2, and a part between both points of origin of the discharge spark S generated by such discharge is formed in a step shape along the outer peripheral surface of the insulator exposed portion 310 of the insulator protruding portion 31. The discharge is generated in the step shape as described above, and therefore, the distance for creeping discharge can be ensured as compared to the case of linearly generating discharge. Further, the area of the section of a tip end portion of the insulator protruding portion 31 perpendicular to the plug axial direction Z is decreased, and therefore, thermal losses due to loss of heat from the flame generated by discharge of a spark plug 1 by the insulator protruding portion 31 can be reduced. This also can improve performance of ignition of an air-fuel mixture.

Moreover, as viewed in the plug axial direction Z, the exposed portion 41 of the center electrode 4 is formed within the ground electrode 2. Thus, productivity of the spark plug 1 is easily improved. That is, a structure configured such that other components than the housing 11 and the ground electrode 2 are assembled with an insulator 3 is formed in advance, and is inserted into the housing 11 and the ground electrode 2 from the base end side of the housing 11 and the ground electrode 2 so that the spark plug 1 can be easily manufactured. Conversely, in a case where the exposed portion 41 of the center electrode 4 is formed with a larger diameter than that of the ground electrode 2, the exposed portion 41 of the center electrode 4 cannot be inserted into the ground electrode 2. Thus, the insulator 3 not assembled with the exposed portion 41 of the center electrode 4 needs to be first inserted into the ground electrode 2, and thereafter, the exposed portion 41 of the center electrode 4 needs to be assembled with the insulator 3 from the tip end side, for example. This leads to an increase in a manufacturing step.

On other points, features and advantageous effects similar to those of the first embodiment are provided.

Ninth Embodiment

Figure 32:
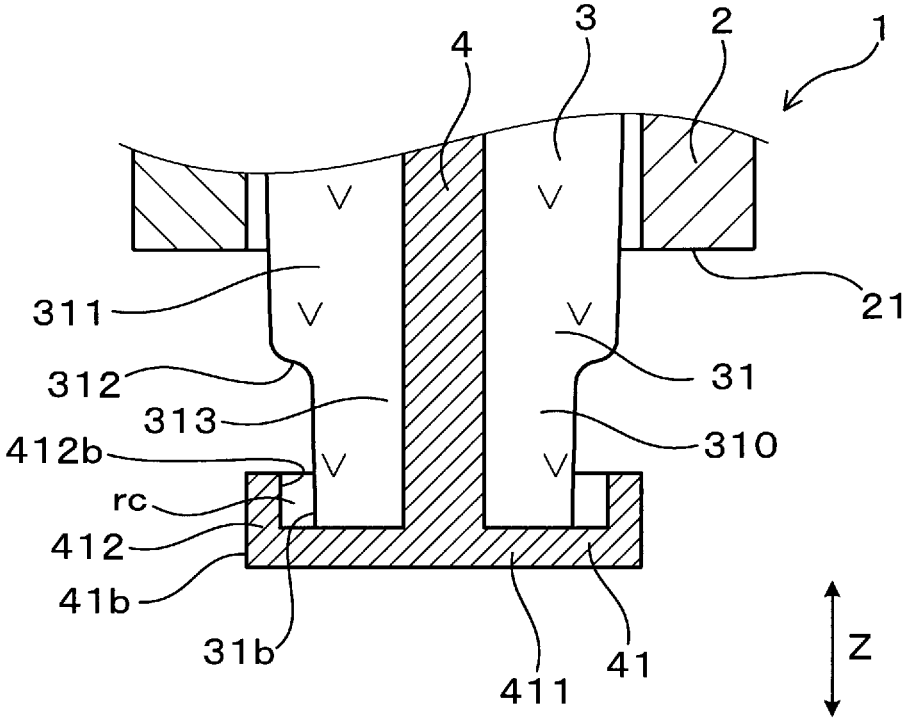
FIG. 32 is an enlarged sectional view of the periphery of a tip end portion of a spark plug in a ninth embodiment.

The present embodiment is an embodiment in which a basic structure is similar to that of the eighth embodiment but the radial gap rc described in the first embodiment is formed between an outer peripheral surface 31*b* of an insulator protruding portion 31 and an inner peripheral surface 412*b* of a second part 412 in a plug radial direction as illustrated in FIG. 32. That is, the inner peripheral surface 412*b* of the second part 412 is formed at a position apart from the outer peripheral surface 31*b* of the insulator protruding portion 31 to an outer peripheral side in a plug radial direction. The radial gap rc is formed in an annular shape across an entire circumference in a plug circumferential direction. The radial gap rc opens to a base end side in a plug axial direction Z.

Note that in the present embodiment, the position of an outer peripheral surface 41*b* of an exposed portion 41 of a center electrode 4 in the plug radial direction is formed equal to the position of an inner peripheral surface of a ground electrode 2.

Other points are similar to those of the eighth embodiment.

In the present embodiment, an air flow in a combustion chamber also flows into the radial gap rc. Then, the air flow having flowed into the radial gap rc flows out toward the outside in the plug radial direction, i.e., toward a side apart from an insulator exposed portion 310, between the center electrode 4 and the ground electrode 2. Thus, the discharge spark is easily extended away from the insulator exposed portion 310.

On other points, features and advantageous effects similar to those of the eighth embodiment are provided.

Tenth Embodiment

Figure 33:
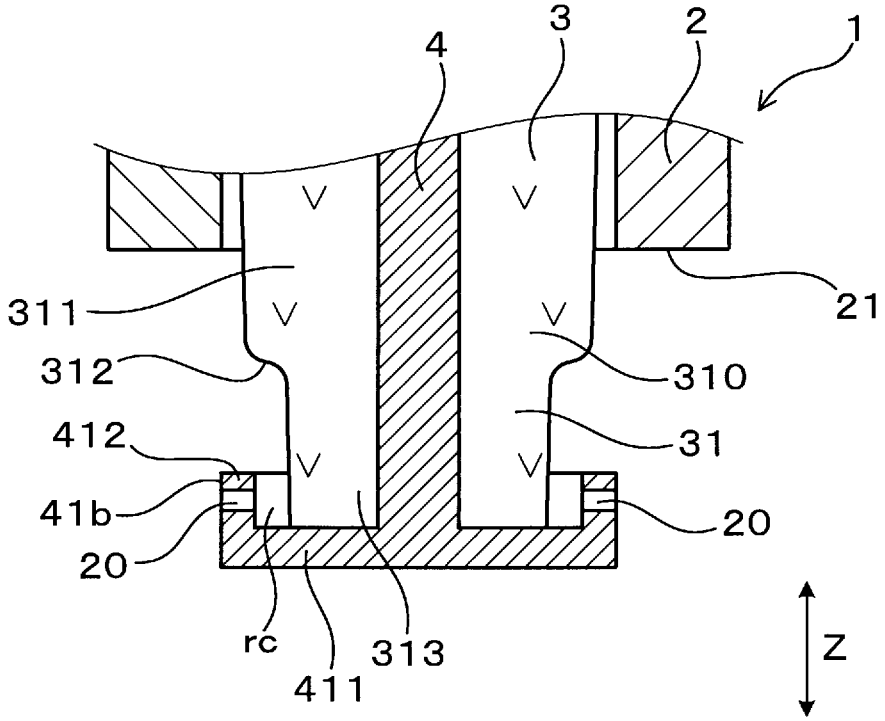
FIG. 33 is an enlarged sectional view of the periphery of a tip end portion of a spark plug in a tenth embodiment.

The present embodiment is an embodiment in which a basic structure is similar to that of the ninth embodiment but through-holes 20 are formed at a second part 412 of a center electrode 4 as illustrated in FIG. 33. The configuration, formation position, etc. of the through-hole 20 are similar to those of the through-hole 20 described in the sixth embodiment.

Other points are similar to those of the ninth embodiment.

In the present embodiment, features and advantageous effects similar to those of the sixth and ninth embodiments are provided.

Eleventh Embodiment

Figure 34:
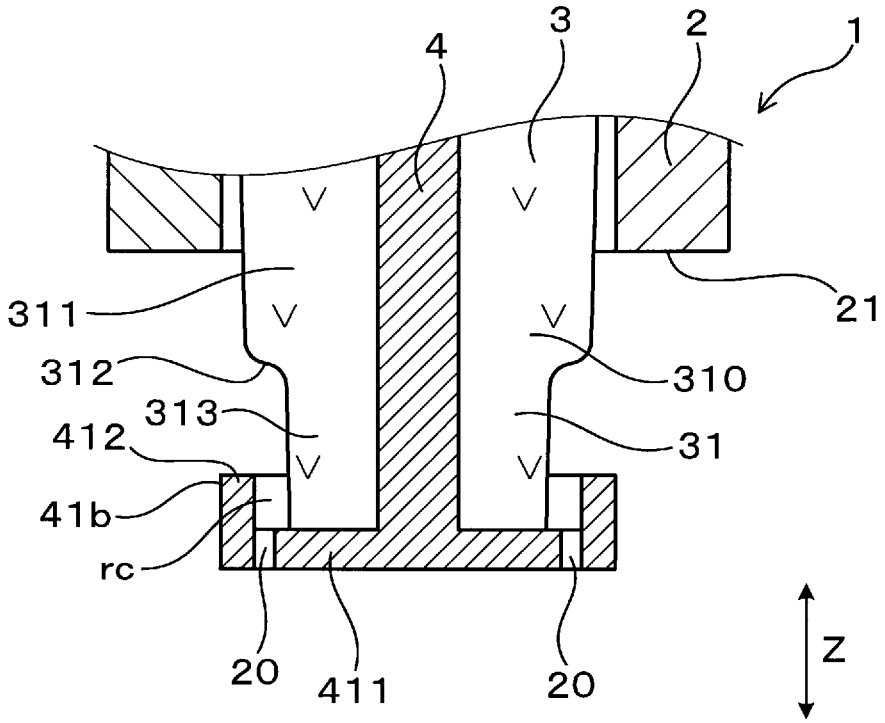
FIG. 34 is an enlarged sectional view of the periphery of a tip end portion of a spark plug in an eleventh embodiment.

The present embodiment is an embodiment in which a basic structure is similar to that of the ninth embodiment but through-holes 20 are formed at a first part 411 of a center electrode 4 as illustrated in FIG. 34. The configuration, formation position, etc. of the through-hole 20 are similar to those of the seventh embodiment.

In the present embodiment, features and advantageous effects similar to those of the seventh and ninth embodiments are provided.

Twelfth Embodiment

Figure 35:
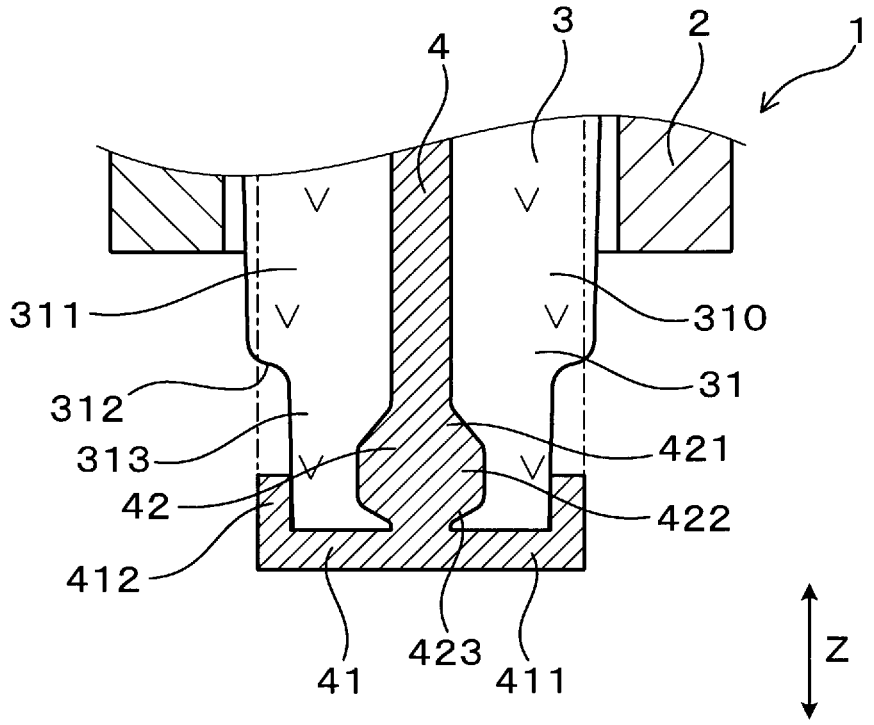
FIG. 35 is an enlarged sectional view of the periphery of a tip end portion of a spark plug in a twelfth embodiment.

The present embodiment is an embodiment in which the shape of a center electrode 4 is changed from that of the eighth embodiment as illustrated in FIG. 35.

In the present embodiment, a part of the center electrode 4 within an insulator protruding portion 31 has an electrode large-diameter portion 42 protruding to an outer peripheral side in a plug radial direction. That is, the electrode large-diameter portion 42 is formed at a tip end portion at the part of the center electrode 4 within the insulator protruding portion 31. In a plug axial direction Z, the electrode large-diameter portion 42 is positioned on a tip end side with respect to an insulator step portion 312. That is, the electrode large-diameter portion 42 is formed inside an insulator small-diameter portion 313 of the insulator protruding portion 31. The tip end side of the electrode large-diameter portion 42 is connected to an exposed portion 41.

The electrode large-diameter portion 42 has a shape rotationally symmetrically about a plug center axis. An electrode expanded-diameter portion 421, an electrode identical-diameter portion 422, and an electrode narrowed-diameter portion 423 are formed in this order from a base end side to the tip end side in the plug axial direction Z at the electrode large-diameter portion 42. The electrode expanded-diameter portion 421 expands the diameter thereof toward the tip end side in the plug axial direction Z. The electrode identical-diameter portion 422 is in a circular columnar shape formed straight in the plug axial direction Z to extend from the expanded-diameter portion 421 to the tip end side in the plug axial direction Z. The electrode narrowed-diameter portion 423 narrows the diameter thereof from the electrode identical-diameter portion 422 to the tip end side in the plug axial direction Z. A diameter change in association with a change in the plug axial direction Z is greater at the electrode narrowed-diameter portion 423 than at the expanded-diameter portion 421.

Other points are similar to those of the eighth embodiment.

In the present embodiment, the electrode large-diameter portion 42 is formed at the part within the insulator protruding portion 31, and therefore, occurrence of pre-ignition is easily prevented. This will be described later.

First, in the present embodiment, the insulator protruding portion 31 has, as a whole, such a step shape that an outer diameter decreases in a stepwise manner toward the tip end side in the plug axial direction Z, and therefore, the thermal capacity of a tip end portion of the insulator protruding portion 31 is decreased and a temperature is easily increased. Accordingly, the temperature of a tip end portion of the center electrode 4 positioned at the periphery of the tip end portion of the insulator protruding portion 31 is also easily increased. Thus, as in the present embodiment, the electrode large-diameter portion 42 is formed at the part within the insulator protruding portion 31 to ensure the thermal capacity of the tip end portion of the center electrode 4, and therefore, a rapid increase in the temperature of the tip end portion of the center electrode 4 can be prevented.

On other points, features and advantageous effects similar to those of the eighth embodiment are provided.

Thirteenth Embodiment

The present embodiment is an embodiment in which the shape of an exposed portion 41 of a center electrode 4 is changed from that of the eighth embodiment as illustrated in FIGS. 36 to 39.

Figure 36:
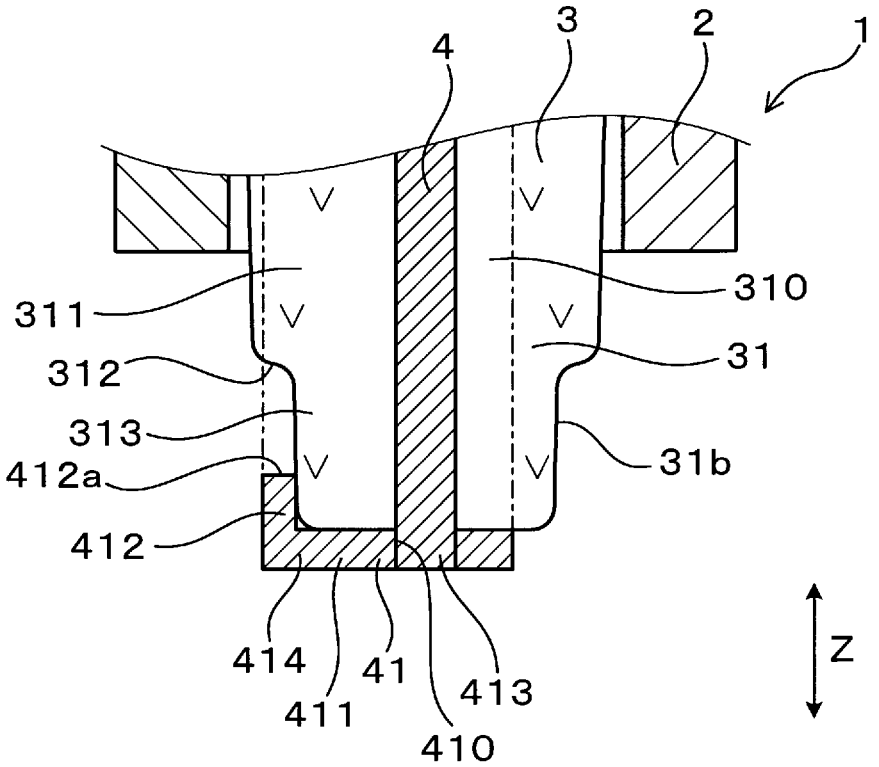
FIG. 36 is an enlarged sectional view of the periphery of a tip end portion of a spark plug in a thirteenth embodiment.
Figure 39:
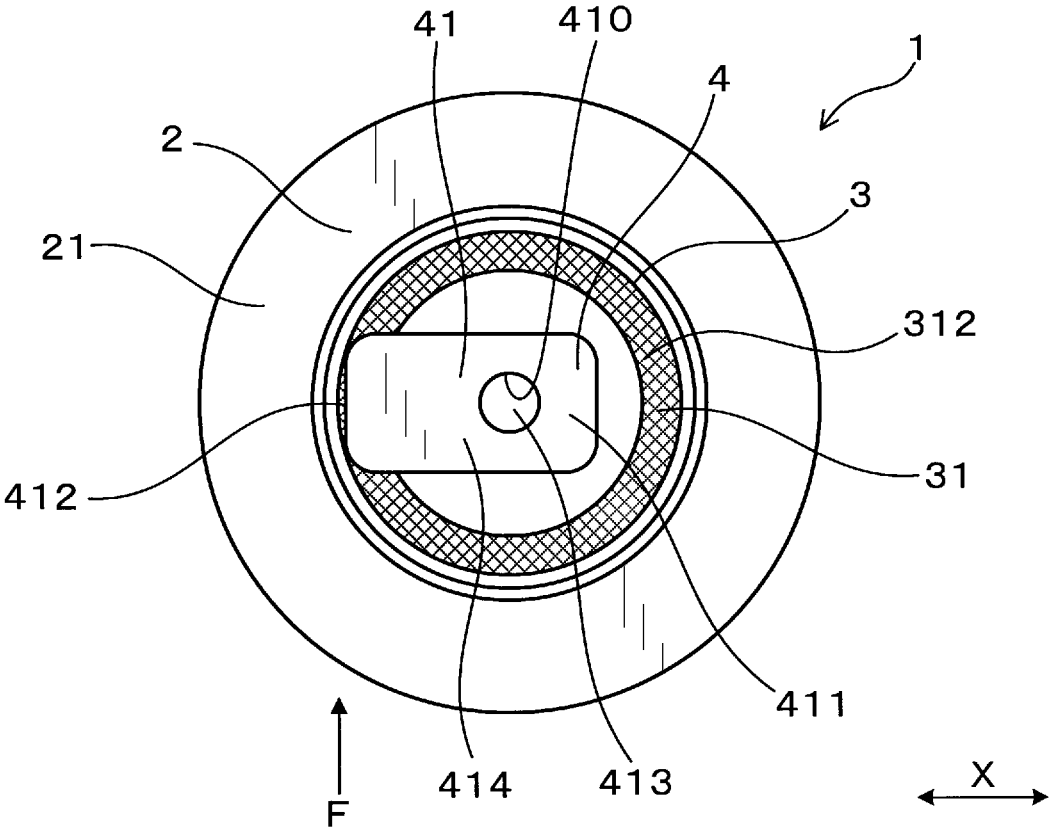
FIG. 39 is a view of a center electrode, an insulator, and a ground electrode viewed from a tip end side in a plug axial direction in the thirteenth embodiment.

As illustrated in FIGS. 36 and 39, the exposed portion 41 has an extending exposed portion 413 extending from a part of the center electrode 4 within an insulator 3 to a tip end side, and an attachment exposed portion 414 attached to the extending exposed portion 413. The extending exposed portion 413 and the attachment exposed portion 414 are separated from each other. The extending exposed portion 413 is in a circular columnar shape. At the attachment exposed portion 414, an attachment hole 410 penetrating the attachment exposed portion 414 in a plug axial direction Z and having the substantially same diameter as that of the extending exposed portion 413 is formed. Moreover, the attachment exposed portion 414 is joined to the extending exposed portion 413 with the extending exposed portion 413 being inserted into the attachment hole 410.

As illustrated in FIG. 36, the attachment exposed portion 414 has a first part 411 and a second part 412. The first part 411 covers an insulator protruding portion 31 from the tip end side in the plug axial direction Z. The second part 412 extends from the first part 411 to a base end side in a plug axial direction Z, and from an outer peripheral side in a plug radial direction, covers part of an outer peripheral surface 31*b* of an insulator protruding portion 31 in a plug circumferential direction.

Figure 37:
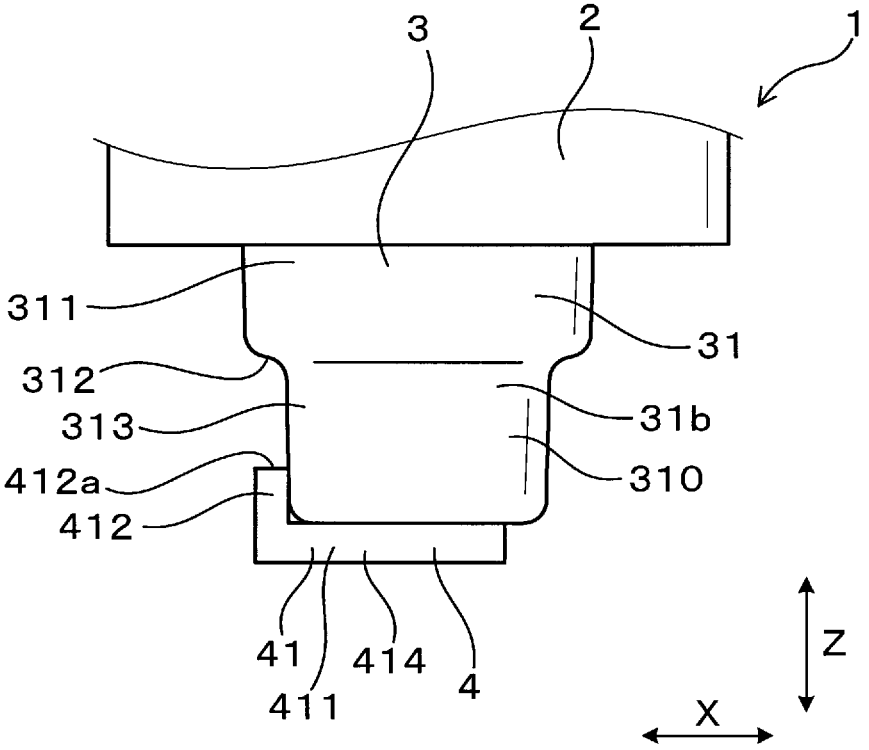
FIG. 37 is an enlarged side view of the periphery of the tip end portion of the spark plug in the thirteenth embodiment.

As illustrated in FIG. 39, the first part 411 is formed in a rounded rectangular shape elongated in a lateral direction X perpendicular to the plug axial direction Z and in a plate shape having a thickness in the plug axial direction Z. The above-described attachment hole 410 is formed at the first part 411. As illustrated in FIGS. 36 and 37, one of side portions of the first part 411 in the lateral direction X is formed to protrude more to the outer peripheral side than an outer peripheral end of a tip end surface 31*a* of the insulator protruding portion 31 does.

Figure 38:
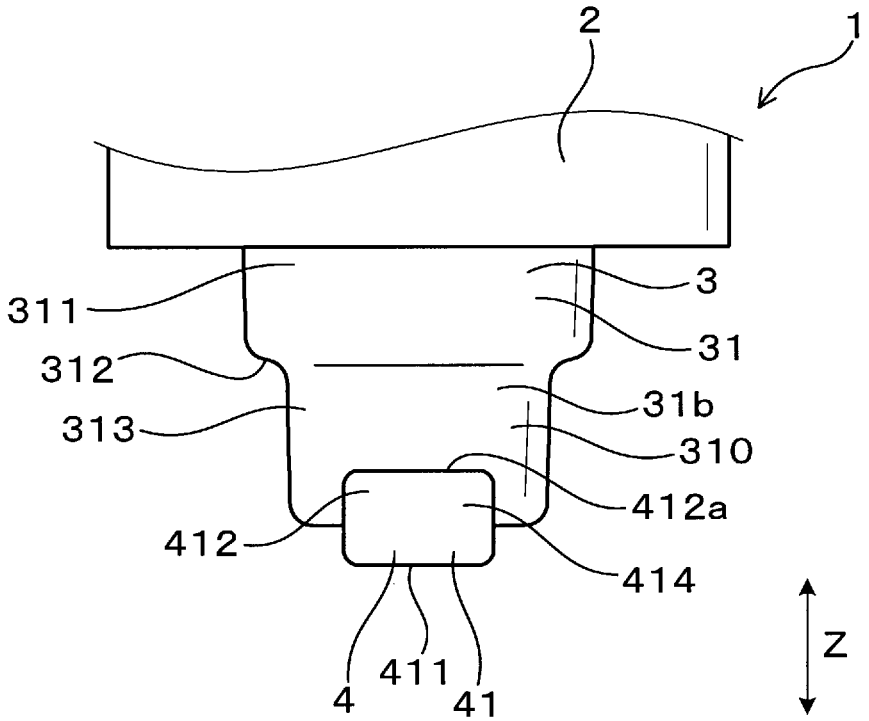
FIG. 38 is an enlarged front view of the periphery of the tip end portion of the spark plug in the thirteenth embodiment.

Moreover, the second part 412 extends from one end portion of the first part 411 in the lateral direction X to the base end side. The second part 412 is formed in a plate shape having a thickness in the lateral direction X. Moreover, as illustrated in FIG. 38, the second part 412 is in a rounded square shape shorter in the plug axial direction Z.

The first part 411 and the second part 412 cover part of a corner portion of a tip end portion of the insulator protruding portion 31 in the plug circumferential direction. The second part 412 is formed along an outer peripheral surface of an insulator small-diameter portion 313. Moreover, in the present embodiment, a base-end-side end surface 412*a* of the second part 412 is formed at a position separated from an insulator step portion 312 toward the tip end side.

As illustrated in FIG. 39, it is configured such that an air flow of an air-fuel mixture passing through a tip end portion of a spark plug 1 flows, as viewed in the plug axial direction Z, in a direction perpendicular to an arrangement direction (i.e., the lateral direction X) of the second part 412 and a plug center axis. The air flow described herein is an air flow of an air-fuel mixture passing through the tip end portion of the spark plug 1 at engine ignition timing. An attachment posture of the spark plug 1 in an internal combustion engine can be adjusted in such a manner that, e.g., the method for cutting a screw of an attachment screw portion (see a reference numeral 111 of FIG. 1) of a housing (see a reference numeral 11 of FIG. 1) is adjusted considering an air flow at the periphery of the tip end portion of the spark plug 1 in a combustion chamber.

Other points are similar to those of the eighth embodiment.

In the present embodiment, part of the corner portion of the tip end portion of the insulator protruding portion 31 is covered with the first part 411 and the second part 412 of the center electrode 4. Thus, discharge is not generated on the corner portion of the tip end portion of the insulator protruding portion 31, but is formed between the second part 412 of the center electrode 4 and a ground electrode 2. Accordingly, due to the air flow of the air-fuel mixture in the combustion chamber or electrical repulsion, discharge is easily detached from a surface of the insulator protruding portion 31, and is easily extended to a downstream side. Thus, performance of ignition of the air-fuel mixture can be improved.

Further, at least a region, in which the second part 412 is formed, of the insulator protruding portion 31 in the plug circumferential direction has, along the entirety in the plug axial direction Z, such a step shape that an outer diameter decreases in a stepwise manner toward the tip end side in the plug axial direction Z. Thus, a path from the second part 412 to the ground electrode 2 along a surface of an insulator exposed portion 310 can be extended. Thus, a distance for creeping discharge can be ensured without extension of the insulator exposed portion 310 in the plug axial direction Z, and the ignition performance can be enhanced. Further, the area of the section of a tip end portion of the insulator protruding portion 31 perpendicular to the plug axial direction Z is decreased, and therefore, thermal losses due to loss of heat from the flame generated by discharge of the spark plug 1 by the insulator protruding portion 31 can be reduced. This also can improve the performance of ignition of the air-fuel mixture.

Moreover, it is configured such that the air flow of the air-fuel mixture passing through the tip end portion of the spark plug 1 flows, as viewed in the plug axial direction Z, in the direction perpendicular to the arrangement direction (i.e., the lateral direction X) of the second part 412 and the plug center axis. Thus, the air flow in the combustion chamber directly passes between the second part 412 and the ground electrode 2. Accordingly, turbulence of the air flow passing between the second part 412 and the ground electrode 2 can be reduced, and the discharge spark generated between the second part 412 and the ground electrode 2 is much more easily extended.

On other points, features and advantageous effects similar to those of the eighth embodiment are provided.

Fourteenth Embodiment

Figure 40:
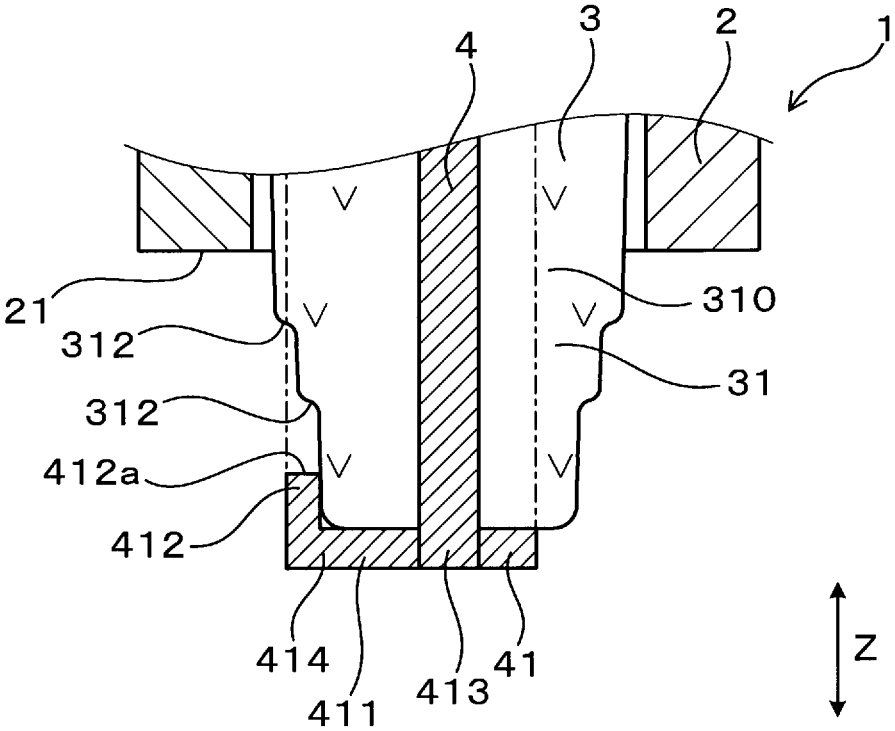
FIG. 40 is an enlarged sectional view of a periphery of a tip end portion of a spark plug in a fourteenth embodiment.

The present embodiment is an embodiment in which the shape of an insulator protruding portion 31 is changed from that of the thirteenth embodiment as illustrated in FIG. 40.

In the present embodiment, the insulator protruding portion 31 has multiple insulator step portions 312. Specifically, the insulator protruding portion 31 has two insulator step portions 312. Two insulator step portions 312 are each arranged at such positions that the insulator exposed portion 310 is trisected in a plug axial direction Z. That is, a base-end-side end surface 412*a* of a second part 412, two insulator step portions 312, and a tip end surface 21 of a ground electrode 2 are arranged at equal intervals in the plug axial direction Z.

Other points are similar to those of the thirteenth embodiment.

In the present embodiment, the insulator protruding portion 31 has multiple insulator step portions 312. Thus, even when the length of the insulator exposed portion 310 in the plug axial direction Z is shortened, a creepage surface distance from the second part 412 to the ground electrode 2 along a surface of the insulator exposed portion 310 can be ensured. Thus, the size of a spark plug 1 can be reduced without influencing ignition performance.

On other points, features and advantageous effects similar to those of the thirteenth embodiment are provided.

Figure 41:
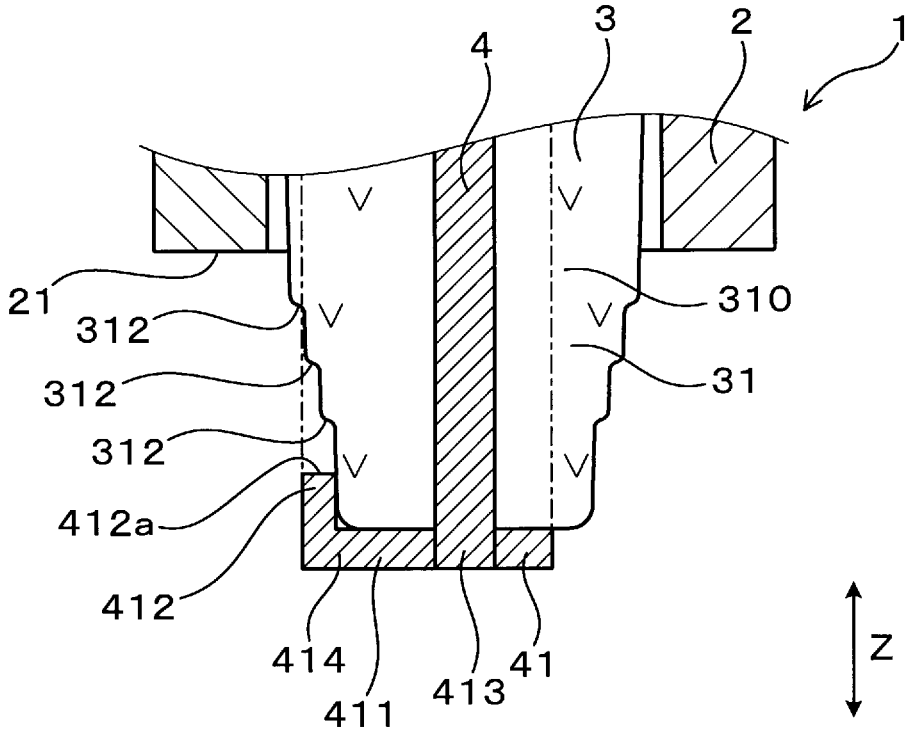
FIG. 41 is an enlarged sectional view of the periphery of a tip end portion of a spark plug in a variation of the fourteenth embodiment.

Note that in the present embodiment, an example where the insulator protruding portion 31 has two insulator step portions 312 has been described, but the present disclosure is not limited to such an example. For example, as illustrated in FIG. 41, three insulator step portions 312 may be formed, or three or more insulator step portions may be formed.

Fifteenth Embodiment

Figure 42:
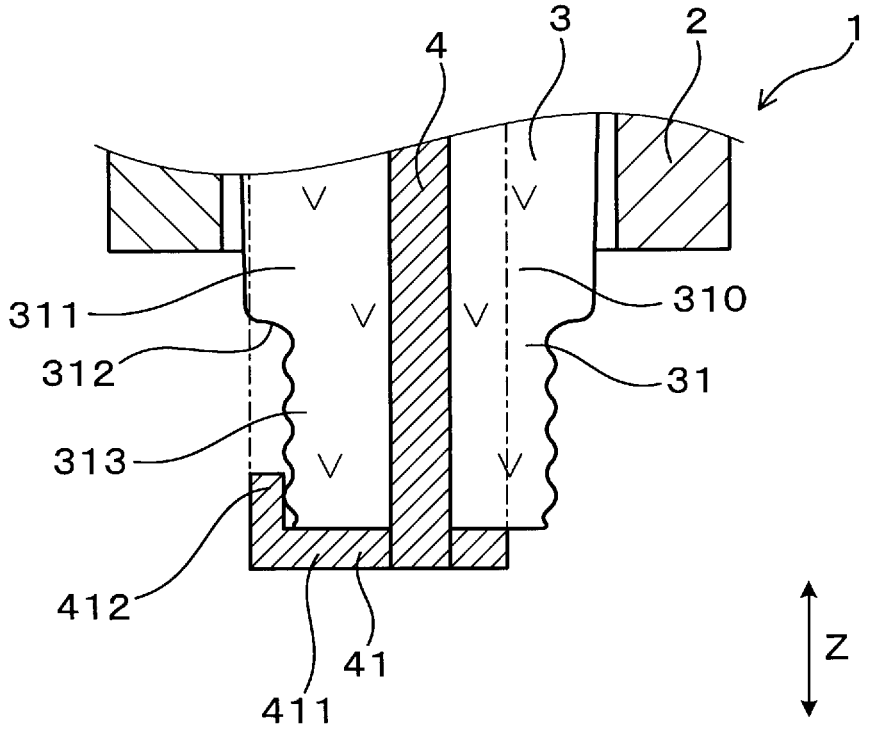
FIG. 42 is an enlarged sectional view of a periphery of a tip end portion of a spark plug in a fifteenth embodiment.

The present embodiment is an embodiment in which the shape of an insulator protruding portion 31 is changed from that of the thirteenth embodiment as illustrated in FIG. 42.

In the present embodiment, an outer peripheral surface of an insulator small-diameter portion 313 is in a corrugated shape (a recessed-raised shape) in a section parallel to a plug axial direction Z. The outer diameter of the insulator small-diameter portion 313 of the present embodiment fluctuates in the plug axial direction Z at a micro level, but the insulator small-diameter portion 313 has a constant outer diameter in the plug axial direction Z at a macro level.

At the macro level, the insulator protruding portion 31 has, along the entirety thereof in the plug axial direction Z, such a step shape that an outer diameter decreases in a stepwise manner toward a tip end side in the plug axial direction Z.

Other points are similar to those of the thirteenth embodiment.

In the present embodiment, the outer peripheral surface of the insulator small-diameter portion 313 is in the corrugated shape. Thus, even when the length of an insulator exposed portion 310 in the plug axial direction Z is shortened, a creepage surface distance from a second part 412 to a ground electrode 2 along a surface of the insulator exposed portion 310 can be ensured. Thus, the size of a spark plug 1 can be reduced without influencing ignition performance.

On other points, features and advantageous effects similar to those of the thirteenth embodiment are provided.

Note that in the present embodiment, only the outer peripheral surface of the insulator small-diameter portion 313 is in the corrugated shape, but the present disclosure is not limited to above. Only an outer peripheral surface of an insulator large-diameter portion 311 may be in a corrugated shape, or both of the outer peripheral surface of the insulator small-diameter portion 313 and the outer peripheral surface of the insulator large-diameter portion 311 may be in the corrugated shape.

Sixteenth Embodiment

Figure 43:
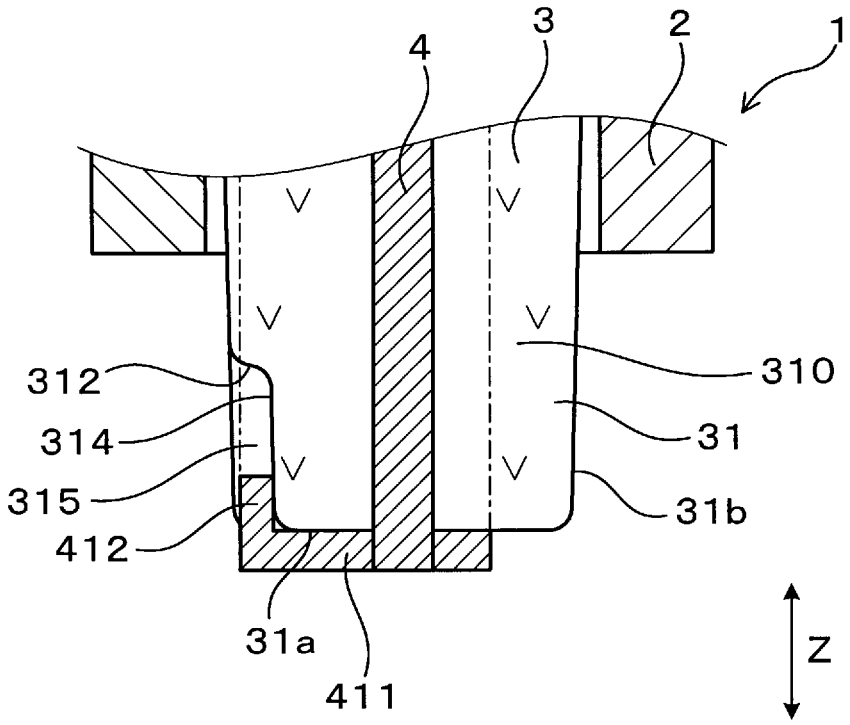
FIG. 43 is an enlarged sectional view of a periphery of a tip end portion of a spark plug in a sixteenth embodiment.
Figure 44:
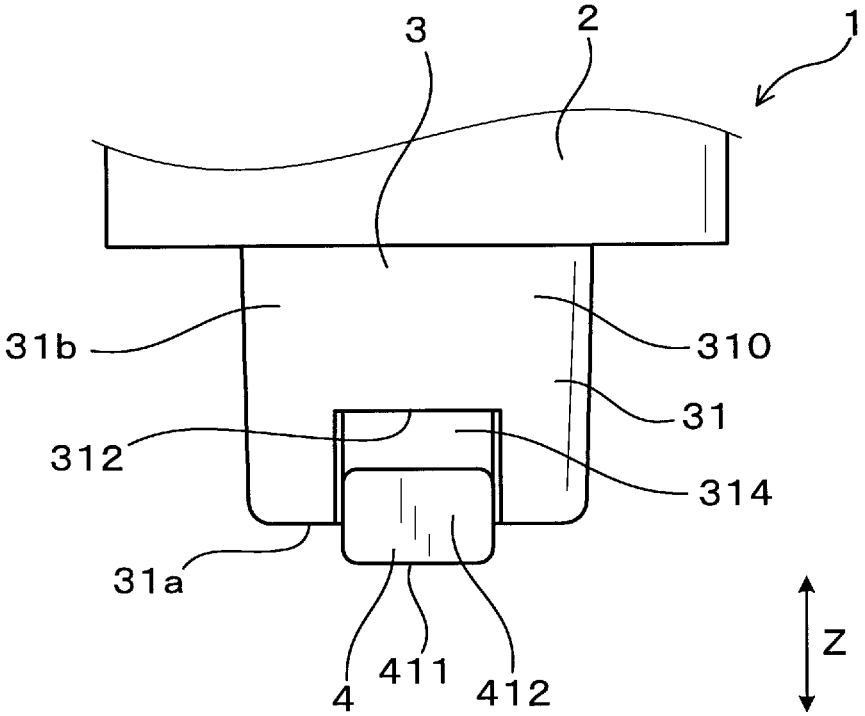
FIG. 44 is an enlarged front view of the periphery of the tip end portion of the spark plug in the sixteenth embodiment.
Figure 45:
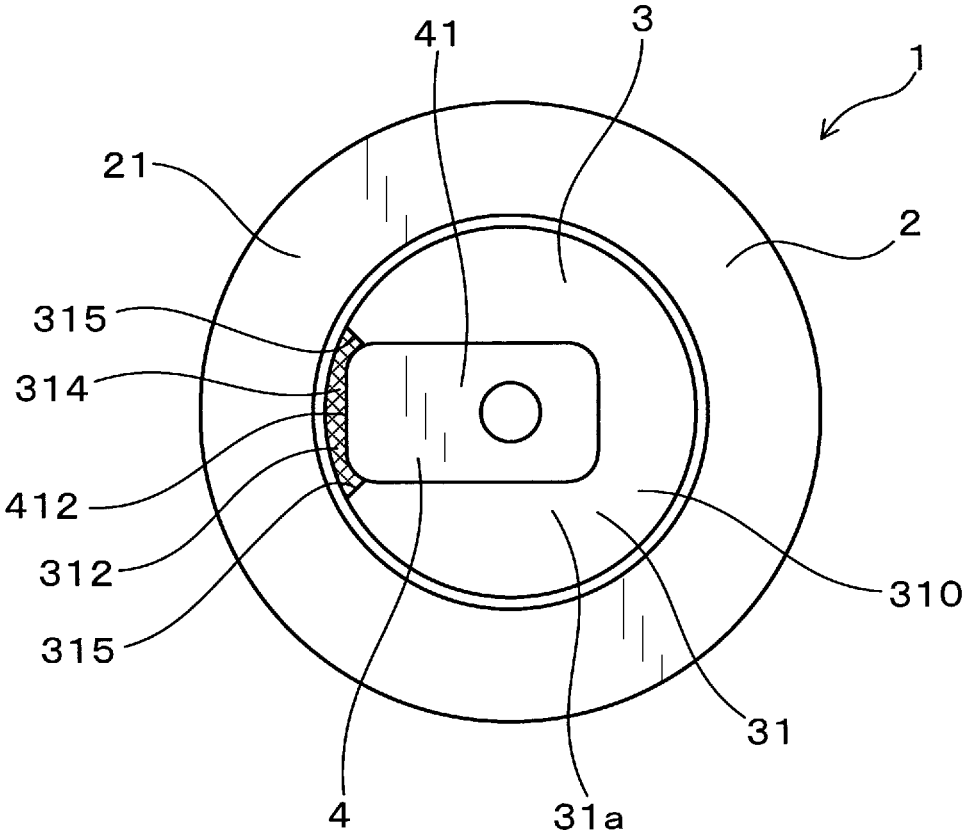
FIG. 45 is a view of a center electrode, an insulator, and a ground electrode viewed from a tip end side in a plug axial direction in the sixteenth embodiment.

The present embodiment is an embodiment in which the shape of an insulator protruding portion 31 is changed from that of the thirteenth embodiment as illustrated in FIGS. 43 to 45. As illustrated in FIGS. 43 and 44, in the present embodiment, a large portion of an outer peripheral surface of the insulator protruding portion 31 has such a shape that a diameter is slightly narrowed toward a tip end side. Moreover, as illustrated in FIGS. 43 to 45, the step shape of the insulator protruding portion 31 is formed only in a region in a plug circumferential direction, a second part 412 being arranged in the region. Such a step shape is formed by a later-described step formation recessed portion 314. The step formation recessed portion 314 is formed such that a region, in which the second part 412 is arranged, of an outer peripheral surface 31*b* of the insulator protruding portion 31 in the plug circumferential direction is recessed radially inward. The step formation recessed portion 314 is formed connected from the center of the insulator protruding portion 31 in a plug axial direction Z to a tip end surface 31*a* of the insulator protruding portion 31. A base-end-side end surface of the step formation recessed portion 314 in the plug axial direction Z is an insulator step portion 312 facing the tip end side in the plug axial direction Z.

Moreover, as illustrated in FIG. 45, both end walls 315 of the step formation recessed portion 314 in the plug circumferential direction are formed in such a tapered shape that the end walls 315 are apart from each other in the plug circumferential direction toward an outer peripheral side in a plug radial direction. Moreover, as illustrated in FIGS. 43 and 44, the second part 412 is formed within the step formation recessed portion 314 in any of the plug circumferential direction and the plug radial direction.

Other points are similar to those of the thirteenth embodiment.

In the present embodiment, the step shape of the insulator protruding portion 31 is, in the plug circumferential direction, formed only in the region in which the second part 412 is arranged. As described above, the step shape is formed only at a spot necessary for ensuring a creepage surface distance. Thus, excessive decrease in the volume of an insulator 3 and excessive decrease in a thermal capacity can be prevented. Thus, occurrence of pre-ignition is easily prevented.

On other points, features and advantageous effects similar to those of the thirteenth embodiment are provided.

Seventeenth Embodiment

The present embodiment is an embodiment in which the shape of a center electrode 4 is changed from that of the thirteenth embodiment.

Figure 46:
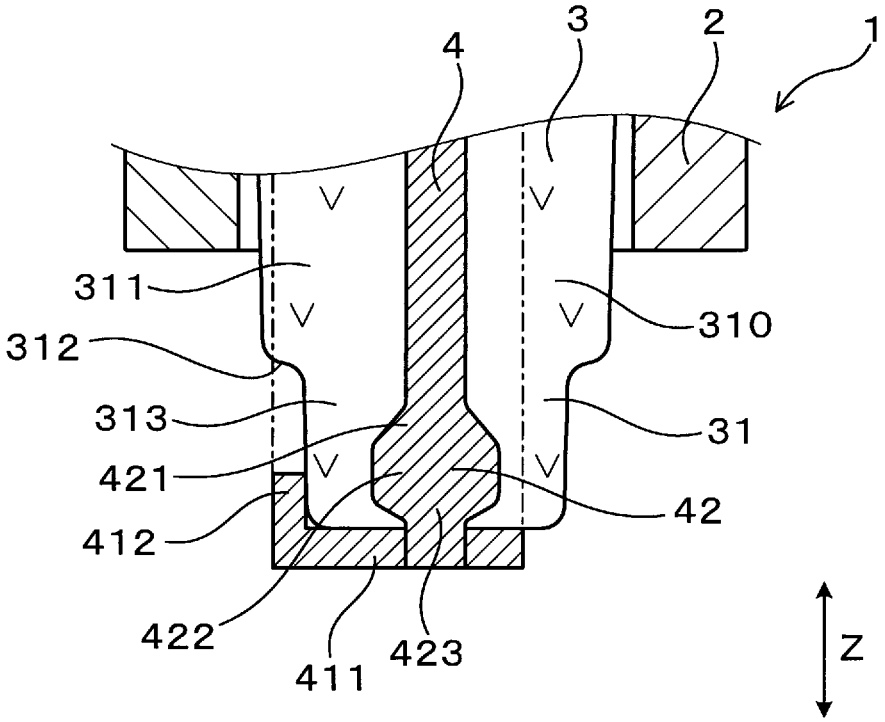
FIG. 46 is an enlarged sectional view of a periphery of a tip end portion of a spark plug in a seventeenth embodiment.

As illustrated in FIG. 46, in the present embodiment, a part of the center electrode 4 within an insulator protruding portion 31 has an electrode large-diameter portion 42 protruding to an outer peripheral side in a plug radial direction. That is, the electrode large-diameter portion 42 is formed at a tip end portion at the part of the center electrode 4 within the insulator protruding portion 31. In a plug axial direction Z, the electrode large-diameter portion 42 is positioned on a tip end side with respect to an insulator step portion 312. That is, the electrode large-diameter portion 42 is formed inside an insulator small-diameter portion 313 of the insulator protruding portion 31. The tip end side of the electrode large-diameter portion 42 is connected to an exposed portion 41. The shape of the electrode large-diameter portion 42 is similar to that of the electrode large-diameter portion 42 of the twelfth embodiment.

Other points are similar to those of the thirteenth embodiment.

In the present embodiment, the electrode large-diameter portion 42 is formed at the part within the insulator protruding portion 31, and therefore, occurrence of pre-ignition is easily prevented as in the twelfth embodiment.

On other points, features and advantageous effects similar to those of the thirteenth embodiment are provided.

The present disclosure is not limited to each of the above-described embodiments, and can be applied to various embodiments without departing from the gist of the present disclosure.

For example, the fourth embodiment and the fifth embodiment may be combined such that the shape of the center electrode is the shape described in the fourth embodiment and the shape of the ground electrode is the shape described in the fifth embodiment.

Moreover, the exposed portion is formed integrally with the part of the center electrode within the insulator protruding portion, but the present disclosure is not limited to above. The exposed portion and the part of the center electrode within the insulator protruding portion may be separated from each other.

Further, the form in which the ground electrode is joined to the tip end portion of the housing has been described, but the housing and the ground electrode may be integrally formed. That is, part of the housing may be the ground electrode.

In addition, in the sixth embodiment and the seventh embodiment, the form in which four ventilation holes are formed at the exposed portion of the center electrode has been described, but the number of ventilation holes at the exposed portion may be one or more.

What is claimed is:

1. An internal combustion engine spark plug comprising:

a tubular ground electrode;

a tubular insulator arranged inside the ground electrode and having an insulator protruding portion protruding to a tip end side in a plug axial direction with respect to a tip end of the ground electrode; and a center electrode held inside the insulator and having an exposed portion exposed through a tip end of the insulator protruding portion, wherein the exposed portion of the center electrode has a first part covering the insulator protruding portion from the tip end side in the plug axial direction, and a second part extending from the first part to a base end side in the plug axial direction and covering an entire circumference of an outer peripheral surface of the insulator protruding portion from an outer peripheral side in a plug radial direction;

an axial gap is formed between the first part and the insulator protruding portion in the plug axial direction; and a tip end surface of the ground electrode has a part inclined toward the base end side in the plug axial direction as extending toward the outer peripheral side in the plug radial direction.

2. The internal combustion engine spark plug according to claim 1, wherein an end surface of the second part on the base end side in the plug axial direction is perpendicular to the plug axial direction.

3. The internal combustion engine spark plug according to claim 1, wherein an outer peripheral surface of the exposed portion has a part inclined toward the outer peripheral side in the plug radial direction as extending toward the tip end side in the plug axial direction.

4. The internal combustion engine spark plug according to claim 1, wherein a spatial distance between the second part of the center electrode and the ground electrode is constant across an entire circumference.

5. The internal combustion engine spark plug according to claim 1, wherein a radial gap is formed between the outer peripheral surface of the insulator protruding portion and an inner peripheral surface of the second part of the center electrode in the plug axial direction.

6. The internal combustion engine spark plug according to claim 5, wherein a ventilation hole penetrating the exposed portion from an inside to an outside and opening toward the radial gap at one end is formed at the exposed portion.

7. The internal combustion engine spark plug according to claim 1, wherein the insulator protruding portion has, as a whole, such a step shape that an outer diameter decreases in a stepwise manner toward the tip end side in the plug axial direction.

8. The internal combustion engine spark plug according to claim 7, wherein a part of the center electrode within the insulator protruding portion has an electrode large-diameter portion protruding to the outer peripheral side in the plug radial direction.

9. An internal combustion engine spark plug comprising:

a tubular ground electrode;

a tubular insulator arranged inside the ground electrode and having an insulator protruding portion protruding to a tip end side in a plug axial direction with respect to a tip end of the ground electrode; and a center electrode held inside the insulator and having an exposed portion exposed through a tip end of the insulator protruding portion, wherein the exposed portion of the center electrode has a first part covering the insulator protruding portion from the tip end side in the plug axial direction, and a second part extending from the first part to a base end side in the plug axial direction and covering an entire circumference of an outer peripheral surface of the insulator protruding portion from an outer peripheral side in a plug radial direction; and the exposed portion of the center electrode is formed within the ground electrode as viewed in the plug axial direction.

10. An internal combustion engine spark plug comprising:

a tubular ground electrode;

a tubular insulator arranged inside the ground electrode and having an insulator protruding portion protruding to a tip end side in a plug axial direction with respect to a tip end of the ground electrode; and a center electrode held inside the insulator and having an exposed portion exposed through a tip end of the insulator protruding portion, wherein the exposed portion of the center electrode has a first part covering the insulator protruding portion from the tip end side in the plug axial direction, and a second part extending from the first part to a base end side in the plug axial direction and covering part of an outer peripheral surface of the insulator protruding portion in a plug circumferential direction from an outer peripheral side in a plug radial direction, at least a region, in which the second part is formed, of the insulator protruding portion in the plug circumferential direction has a step shape having an outer diameter that decreases in a stepwise manner toward the tip end side in the plug axial direction, and as viewed in the plug axial direction, the exposed portion of the center electrode is formed within the ground electrode.

11. The internal combustion engine spark plug according to claim 10, wherein in the plug circumferential direction, the step shape of the insulator protruding portion is formed only in the region in which the second part is arranged.

12. The internal combustion engine spark plug according to claim 10, wherein as viewed in the plug axial direction, an air flow of an air-fuel mixture passing through a tip end portion of the spark plug flows in a direction perpendicular to an arrangement direction of the second part and a plug center axis.

13. The internal combustion engine spark plug according to claim 10, wherein a part of the center electrode within the insulator protruding portion has an electrode large-diameter portion protruding to an outer peripheral side in a plug radial direction.

* * * * *